US008464651B2

(12) United States Patent
Fukao

(10) Patent No.: US 8,464,651 B2
(45) **Date of Patent: *Jun. 18, 2013**

(54) SPOOL HOLDER AND SEWING MACHINE PROVIDED THEREWITH

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 504 days.

This patent is subject to a terminal disclaimer.

(21) Appl. No.: 12/801,507

(22) Filed: Jun. 11, 2010

(65) Prior Publication Data

US 2011/0011319 A1 Jan. 20, 2011

(30) Foreign Application Priority Data

Jul. 15, 2009 (JP) ..... 2009-166770

(51) Int. Cl.
*B65H 59/00* (2006.01)

(52) U.S. Cl.
USPC ..... 112/270

(58) Field of Classification Search
USPC .. 112/270, 258, 259, 302, 279, 255; 242/169, 242/170, 171, 118
See application file for complete search history.

(56) References Cited

U.S. PATENT DOCUMENTS

| | | | |
|---|---|---|---|
| 1,730,431 A | 10/1929 | Keefer | |
| 2,940,685 A | 6/1960 | Glass | |
| 4,351,458 A | 9/1982 | Wolfe | |
| 5,063,866 A | 11/1991 | Jimenez et al. | |
| 7,114,455 B2 | 10/2006 | Prufer et al. | |
| 8,251,000 B2 * | 8/2012 | Fukao | 112/270 |
| 2011/0011318 A1 | 1/2011 | Fukao | |
| 2011/0011319 A1 | 1/2011 | Fukao | |

FOREIGN PATENT DOCUMENTS

| | | |
|---|---|---|
| JP | A-56-73765 | 6/1981 |
| JP | U-58-98074 | 7/1983 |
| JP | U-60-27877 | 2/1985 |
| JP | U-60-30779 | 3/1985 |
| JP | U-5-44073 | 6/1993 |
| JP | U-06-036585 | 5/1994 |
| JP | U-06-046676 | 6/1994 |
| JP | A-06-312073 | 11/1994 |

(Continued)

OTHER PUBLICATIONS

Mar. 8, 2011 Office Action issued in Japanese Patent Application No. 2009-071927 (with translation).

(Continued)

*Primary Examiner* — Tejash Patel
(74) *Attorney, Agent, or Firm* — Oliff & Berridge, PLC

(57) ABSTRACT

A spool holder includes a spool base and a thread guide mechanism including a thread guide member having thread guide portions guiding the threads extending from thread spools, respectively and a divided support pillar disposed so as to support the guide member on the spool base and including an upper support pillar having an upper end swingably mounted on the guide member and a lower support pillar having a lower end which is swingably mounted on the spool base, and a holding unit which holds the divided support pillar so that the pillar is switchable between a first position where both pillars are substantially vertically lined so that the guide member is located at an upper position in its use and a second position where both support pillars are bent at the connecting part so that the guide member is located at an accommodation position in its non-use.

8 Claims, 16 Drawing Sheets

FOREIGN PATENT DOCUMENTS

| | | |
|---|---|---|
| JP | U-06-081478 | 11/1994 |
| JP | A-08-71278 | 3/1996 |
| JP | A-2000-008265 | 1/2000 |
| JP | A-2000-126487 | 5/2000 |
| JP | A-2000-126488 | 5/2000 |
| JP | A-2004-242980 | 9/2004 |
| JP | A-2004-261413 | 9/2004 |
| JP | A-2006-061179 | 3/2006 |
| JP | A-2006-193240 | 7/2006 |
| JP | U-3138430 | 12/2007 |
| JP | A-2010-220846 | 10/2010 |
| JP | A-2011-19699 | 2/2011 |
| JP | A-2011-19700 | 2/2011 |

OTHER PUBLICATIONS

Apr. 19, 2011 Office Action issued in Japanese Patent Application No. 2009-166770 (with translation).

Office Action dated Jan. 20, 2012 issued in U.S. Appl. No. 12/830,776.

Japanese Office Action issued in Japanese Patent Application No. 2009-071927 on Nov. 24, 2010 (with translation).

U.S. Appl. No. 12/697,856, filed Feb. 1, 2010.

U.S. Appl. No. 13/016,352, filed Jan. 28, 2011.

U.S. Appl. No. 12/830,776, filed Jul. 6, 2010.

* cited by examiner

SPOOL HOLDER AND SEWING MACHINE PROVIDED THEREWITH

CROSS-REFERENCE TO RELATED APPLICATIONS

This application is based upon and claims the benefit of priority from the prior Japanese Patent Application No. 2009-166770 filed on Jul. 15, 2009, the entire contents of which are incorporated herein by reference.

BACKGROUND

1. Technical Field

The present disclosure relates to a spool holder including a spool holder base to which a plurality of thread spools is attachable and a thread guide mechanism which guides, at a location higher than the thread spools, threads extending from the thread spools attached to the spool holder base, and a sewing machine provided with the spool holder.

2. Description of the Related Art

Threads drawn from a plurality of thread spools on a spool holder base respectively are guided by a thread guide mechanism at a location higher than the thread spools in conventional sewing machines provided with the aforementioned spool holder. The threads guided by the thread guide mechanism are passed through a predetermined thread supply path in the sewing machine. The threads along the thread supply path are routed through a thread tensioner, a thread take-up lever and the like, extending to a needle. Since the threads are guided by the thread guide mechanism at a relatively higher location in this type of sewing machine, the threads are prevented from being entangled during sewing and accordingly the threads can smoothly be drawn. However, in the case where the guide position is located high, the thread guide mechanism is bulky upward when the sewing machine is accommodated in the disuse of the sewing machine, thereby being cumbersome.

The conventional spool tensioners include a first type in which the thread guide mechanism is vertically movable relative to the sewing machine and a second type in which the thread guide mechanism is downwardly contracted. For example, the first type thread guide mechanism includes a thread guiding member which is mounted on an upper end of a vertically extending support pillar and guides threads extending from the thread spools. The thread guiding member is formed so as to extend substantially horizontally. The support pillar of the thread guide mechanism extends through an upper portion of a bracket arm of the sewing machine. The support pillar is movable upward and downward when inserted into the bracket arm. When the sewing machine is not used, the thread guide mechanism is moved downward relative to the sewing machine when the sewing machine is not used. As a result, the thread guide mechanism can be prevented from protruding upward. However, the thread guide mechanism necessitates a space for accommodating the support pillar inside the bracket arm in the sewing machine. Thus, the first type of thread guide mechanism is subjected to design restrictions at the sewing machine side thereby to be unsuitable for size reduction of the sewing machine.

The second type thread guide mechanism includes a thread guiding member provided on an upper end of a vertically telescopic rod. The sewing machine includes an upwardly protruding support pipe serving as a mounting portion for the thread guide mechanism (the rod). An elevating member is accommodated in the support pipe so as to be movable upward and downward. The rod is formed into a cylindrical shape and has a lower end fixed to the elevating member. In use of the sewing machine, the rod is extended upward and the elevating member is held in an ascended state by the support pipe. In non use of the sewing machine, the rod is contracted and the elevating member is held in a descended state. In this state, the thread guide member is prevented from protruding upward over the sewing machine head.

The rod-shaped member that is axially telescopic generally comprises a plurality of cylindrical members as the rod of the second thread guide mechanism. One of the cylindrical members adjacent to each other is accommodated in the other such that this type of rod becomes contracted. In this contracted state, one of the cylindrical members is drawn out of the other such that the rod is extended. Fitted portions of the cylindrical members of the extended rod are sometimes turned in the circumferential direction inadvertently. In particular, the rod of the thread guide mechanism (the spool holder) supports the thread guide member which is substantially horizontal. Accordingly, the thread guide member is displaced from a predetermined position when the rod is turned. There is a possibility that the displaced thread guide member may not guide the thread to the thread supply path.

SUMMARY

Therefore, an object of the disclosure is to provide a spool holder which can hold the thread guide member at a predetermined position and can be accommodated in compact, and a sewing machine provided with the spool holder.

The present disclosure provides a spool holder comprising a spool base to which a plurality of thread spools are attachable; and a thread guide mechanism that guides a plurality of threads extending from the thread spools attached to the spool base, at a location higher than the thread spools, the thread guide mechanism including a thread guide member having a plurality of thread guide portions that are lined substantially horizontally and guide the threads extending from the thread spools, respectively; a divided support pillar that is disposed so as to support the thread guide member on the spool base and including an upper support pillar having an upper end which is swingably mounted on the thread guide member and a lower support pillar having a lower end which is swingably mounted on the spool base; a connecting part which connects the upper and lower support pillars so that the upper and lower support pillars are swingable; and a holding unit which holds the divided support pillar so that the divided support pillar is switchable between a first position where the upper and lower support pillars are substantially vertically lined so that the thread guide member is located at an upper position in use thereof and a second position where the upper and lower support pillars are bent at the connecting part so that the thread guide member is located at an accommodation position in non-use thereof.

DETAILED DESCRIPTION OF THE DISCLOSURE

First Example

Figure 1:
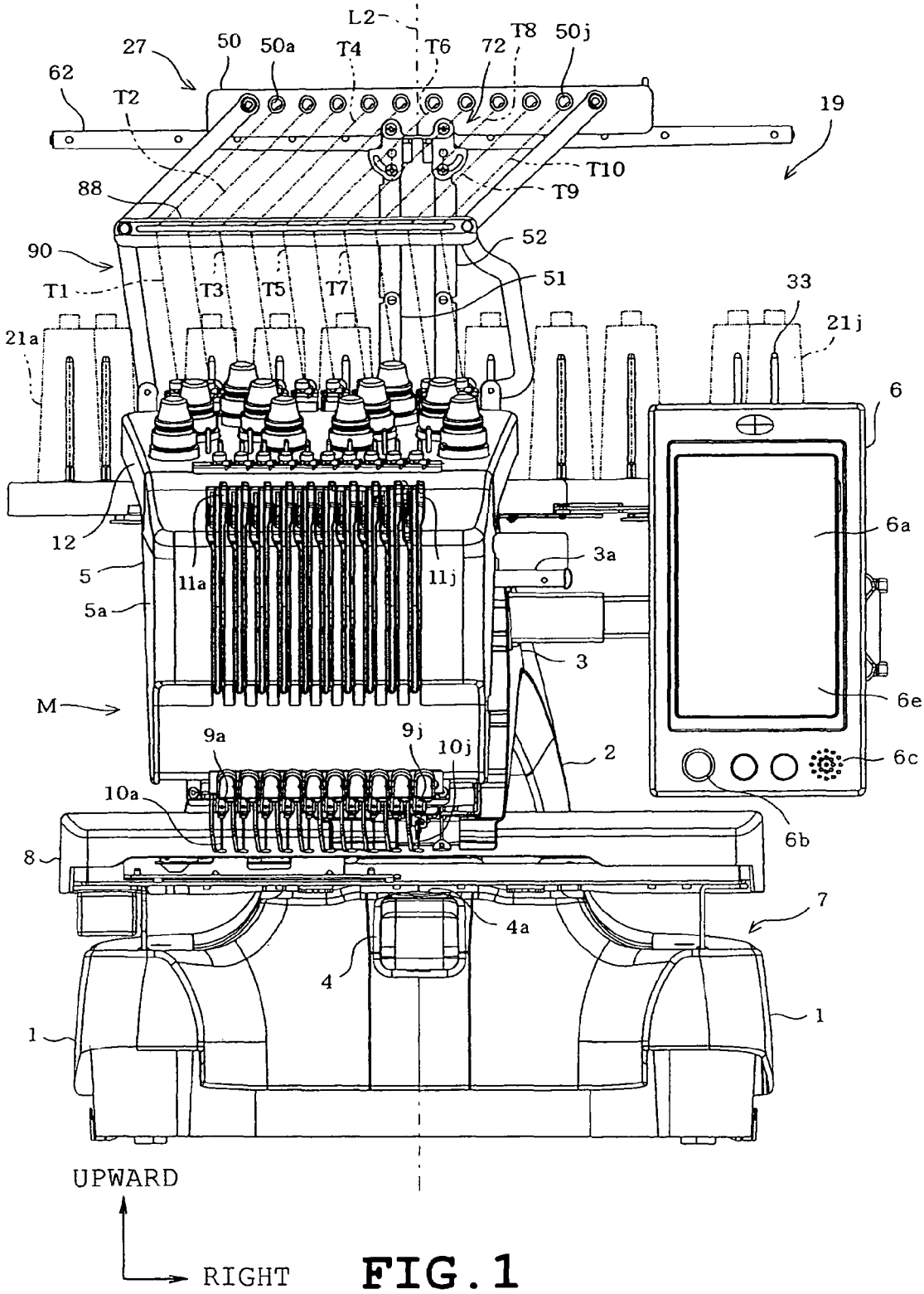
FIG. 1 is a front view of a multi-needle sewing machine provided with a spool holder in accordance with one example.
Figure 2:
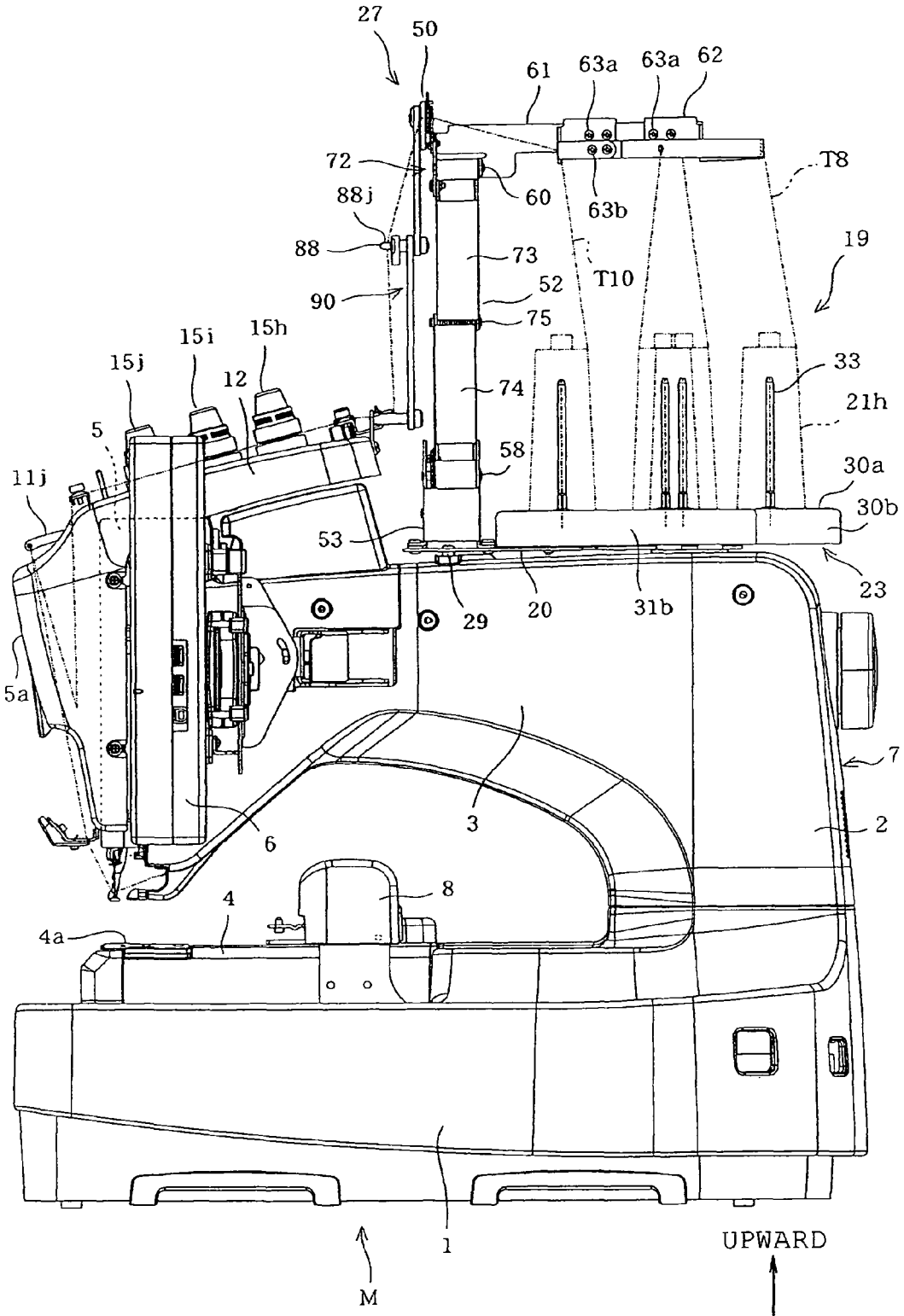
FIG. 2 is a right side view of the multi-needle sewing machine.

A first example applied to the multi-needle sewing machine will be described with reference to FIGS. 1 to 15. In the following description, the user is assumed to be located at the front of the multineedle sewing machine M and the opposite side of the sewing machine will be referred to as "the rear." Furthermore, the front-rear direction will be referred to as "Y direction" and the direction perpendicular to the Y direction will be referred to as "X direction."

Referring to FIGS. 1 to 5, the multi-needle sewing machine M includes a pair of right and left legs 1 supporting the overall sewing machine, a pillar 2 standing on rear ends of the legs 1, an arm 3 extending frontward from an upper part of the pillar 2, a cylinder bed 4 extending frontward from a rear end of the pillar 2, and a needle bar case 5 mounted on a front end of the arm 3. The legs 1, pillar 2, arm 3 and cylinder bed 4 are formed integrally with one another into a sewing machine body 7. A control device 18 (see FIG. 11) controlling the overall multi-needle sewing machine M, and an operation panel 6 are provided at the sewing machine body 7 side. A needle plate 4*a* is mounted on an upper surface of the cylinder bed 4. The needle plate 4*a* is formed with a needle hole (not shown) serving as a needle position for needles 10*a* to 10*j* as will be described later.

A carriage 8 directed in the right-left direction is disposed above the legs 1. A frame bracket (not shown) is mounted on the front side of the carriage 8. An X-direction drive mechanism (not shown) is provided inside the carriage 8 to drive the frame bracket in the X direction (the right-left direction). A Y-direction drive mechanism (not shown) is provided inside the legs 1 to drive the carriage 8 in the Y direction (the front-back direction). A workpiece cloth on which embroidery is to be sewn is held by a generally rectangular embroidery frame (not shown). The embroidery frame holding the workpiece cloth is mounted on the frame bracket. The embroidery frame is moved in the Y direction in synchronization with the carriage 8 by the Y-direction drive mechanism or in the X direction together with the frame bracket by the X-direction drive mechanism. Thus, the workpiece cloth is fed by the movement of the embroidery frame.

Figure 5:
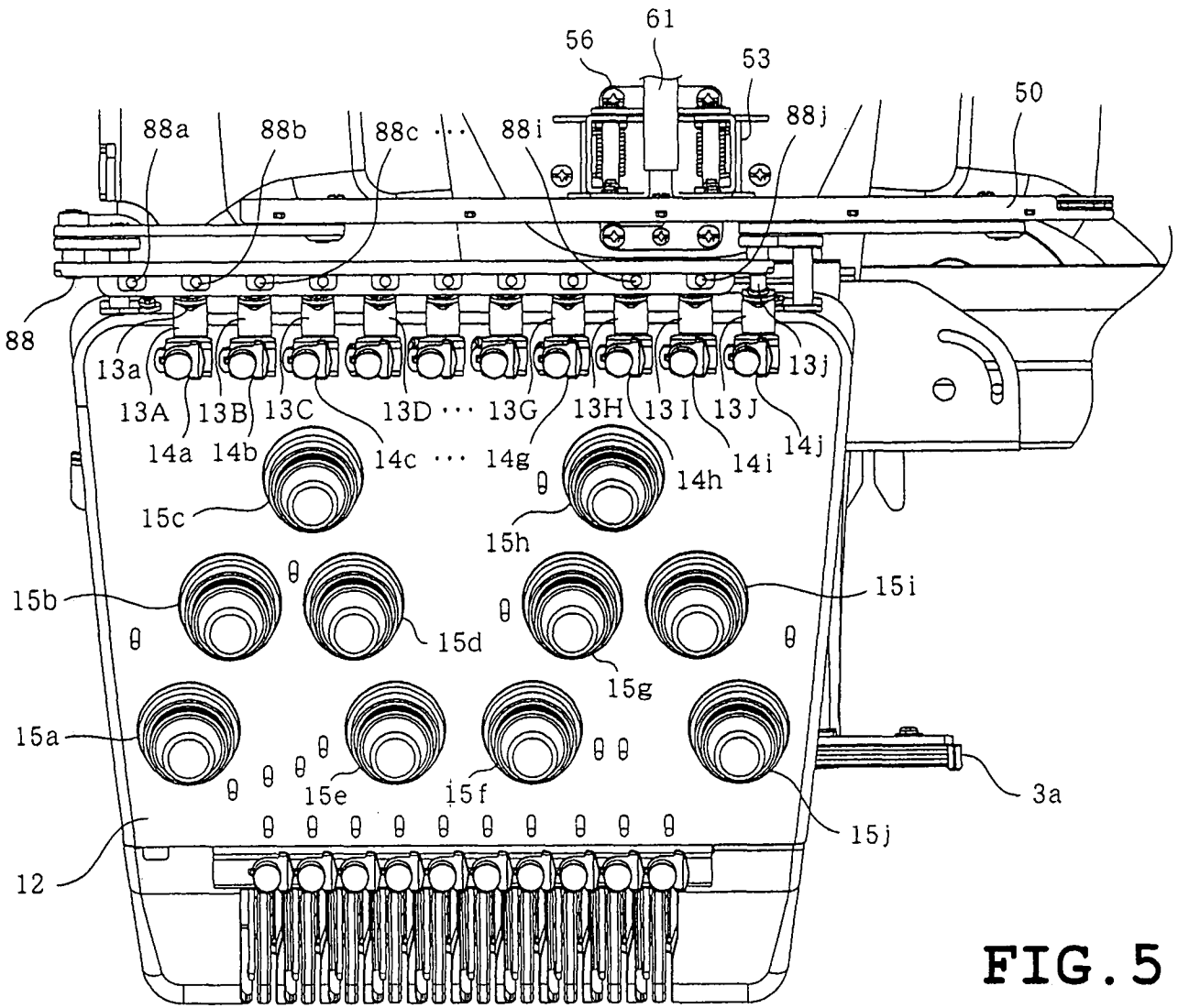
FIG. 5 is a plan view of a thread tension bracket.

Ten needle bars 9*a* to 9*j* are arranged in the right-left direction so as to extend in the up-down direction in the needle bar case 5 and supported so as to be movable upward and downward. Ten needles 10*a* to 10*j* are attached to lower ends of the needle bars 9*a*-9*j* respectively. Ten thread take-up levers 11 corresponding to the respective needle bars 9*a*-9*j* are also provided in the needle bar case 5 so as to be movable upward and downward. A cover 5*a* made of a synthetic resin is mounted on a front side of the needle bar case 5. A thread tension bracket 12 is mounted on the upper surface of the needle bar case 5 so as to be inclined forwardly downward and so as to be continuous to the upper end of the cover 5*a*. Ten cylindrical thread introducing members 13A to 13J are aligned on a rear end of the thread tension bracket 12 in the right-left direction as shown in FIG. 5. Ten auxiliary thread guides 14*a* to 14*j* are provided on the front sides of the thread entrances 13*a*-13*j* respectively. Ten thread tensioners 15*a* to 15*j* are mounted on the thread tension bracket 12 to adjust tensions of needle threads supplied to the needles 10*a*-10*j* respectively.

Figure 11:
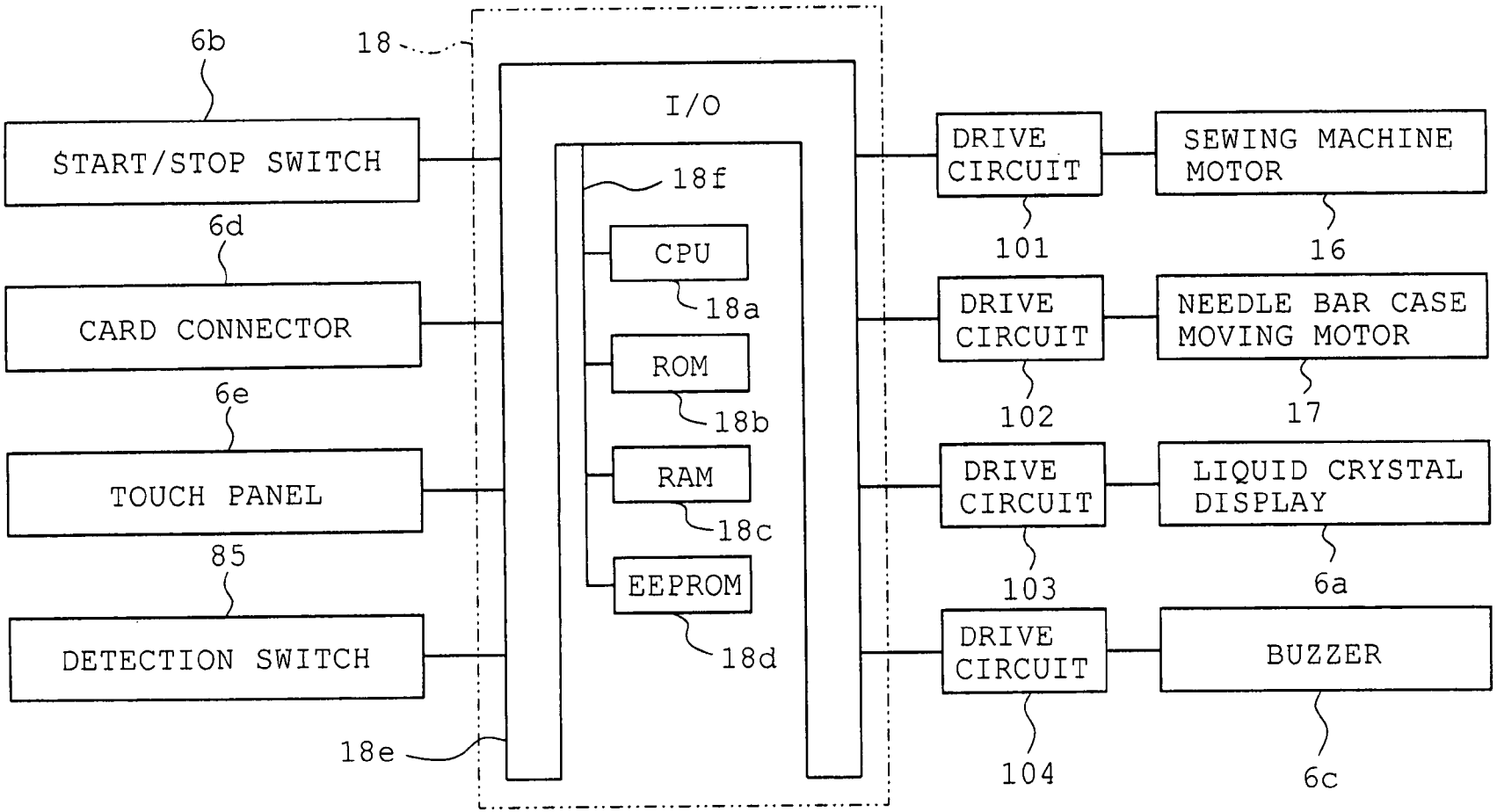
FIG. 11 is a block diagram showing an electrical arrangement of the sewing machine.

A guide rail 3*a* is provided on a front end of the arm 3 so as to extend in the right-left direction as shown in FIG. 1. The needle bar case 5 is supported on the guide rail 3*a*. The needle bar case 5 is slid in the X direction or the right-left direction along the guide rail 3*a*. A needle bar case moving mechanism (not shown) is provided in the arm 3 for moving the needle bar case 5 in the X direction. A needle bar case moving motor 17 (see FIG. 11) serves as a drive source for the needle bar case moving mechanism. A sewing machine motor 16 is provided in the pillar 2 as shown in FIG. 11.

Upon drive of the needle bar case moving motor 17, one of ten sets of the needle bars 9*a*-9*j* and the thread take-up levers 11*a* to 11*j* is selectively switched to the needle position. The switched set of the needle bar and the thread take-up lever is synchronously moved upward and downward by the drive of the sewing machine motor 16. The cylinder bed 4 has a front end on which a rotating hook (not shown) is provided. Embroidery stitches are formed on the workpiece cloth in cooperation of the needle bar and the rotating hook.

The operation panel 6 has a vertically long liquid crystal display 6*a* serving as a display section. The display 6 displays various pieces of sewing-related information necessary for a sewing work, information about a set state of the thread guide mechanism 27 which will be described later, and the like. The operation panel 6 has a lower front on which are provided a plurality of switches including a start/stop switch 6*b* and the buzzer 6*c*. The operation panel 6 also has a side formed with a card connector 6*d* (see FIG. 11) into which a memory card (not shown) is inserted, and the like. The memory card stores data of various embroidery patterns and the like. A touch panel 6*e* is mounted on the front of the liquid crystal display 7 and has a plurality of touch keys comprising a transparent electrode. The touch key is operated so that various instructions regarding selection of an embroidery pattern and sewing are delivered.

A spool holder 19 provided on the upper surface side of the sewing machine body 7 will now be described. The spool holder 19 includes a flat plate-shaped support base 20 disposed on the upper surface of the arm 3, a pair of divided spool brackets 22 and 23, a pair of support shafts 24 and 25 (see FIG. 4) and a thread guide mechanism 27. For example, ten thread spools 21*a* to 21*j* are placed on the divided spool brackets 22 and 23. The divided spool brackets 22 and 23 are mounted on the support base 20 by the support shafts 24 and 25 so as to be swingable in a horizontal plane.

Figure 4:
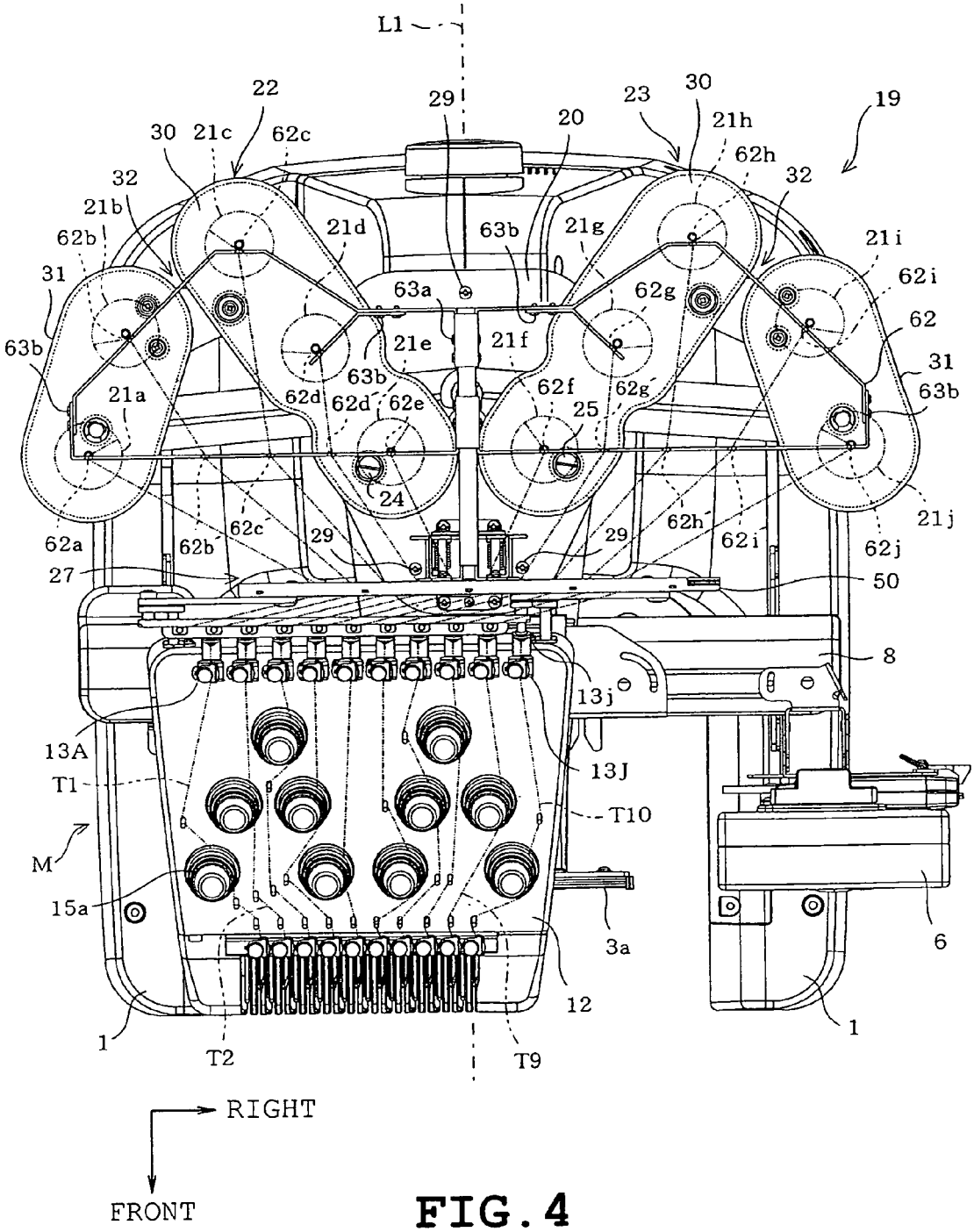
FIG. 4 is a plan view of the multi-needle sewing machine.

The support base 20 and the divided spool brackets 22 and 23 constitute a spool bracket. The spool bracket 22 is fixed to an upper surface of the arm 3 as a spool base by a plurality of screws 29 as shown in FIG. 4. Each divided spool bracket 22, 23 is divided into, for example, two parts. The divided spool brackets 22 and 23 are supported on the support shafts 24 and 25 so as to be switchable between a use position as shown in FIG. 4 and an accommodation position, respectively. Each divided spool bracket 22, 23 located at the use position is spread into an M-shape as viewed in a plan view. Each divided spool bracket 22, 23 located at the accommodation position is closed from the use position thereby to be adjacent to each other substantially in a horizontal state. An imaginary straight line L1 in FIG. 6 extends in the front-rear direction through the center of the sewing machine body 7. The divided spool brackets 22 and 23 have the same structure and are disposed bilaterally symmetrically about the line L1 serving as an axis of symmetry. The left divided spool bracket 22 will mainly be described in the following.

Figure 3:
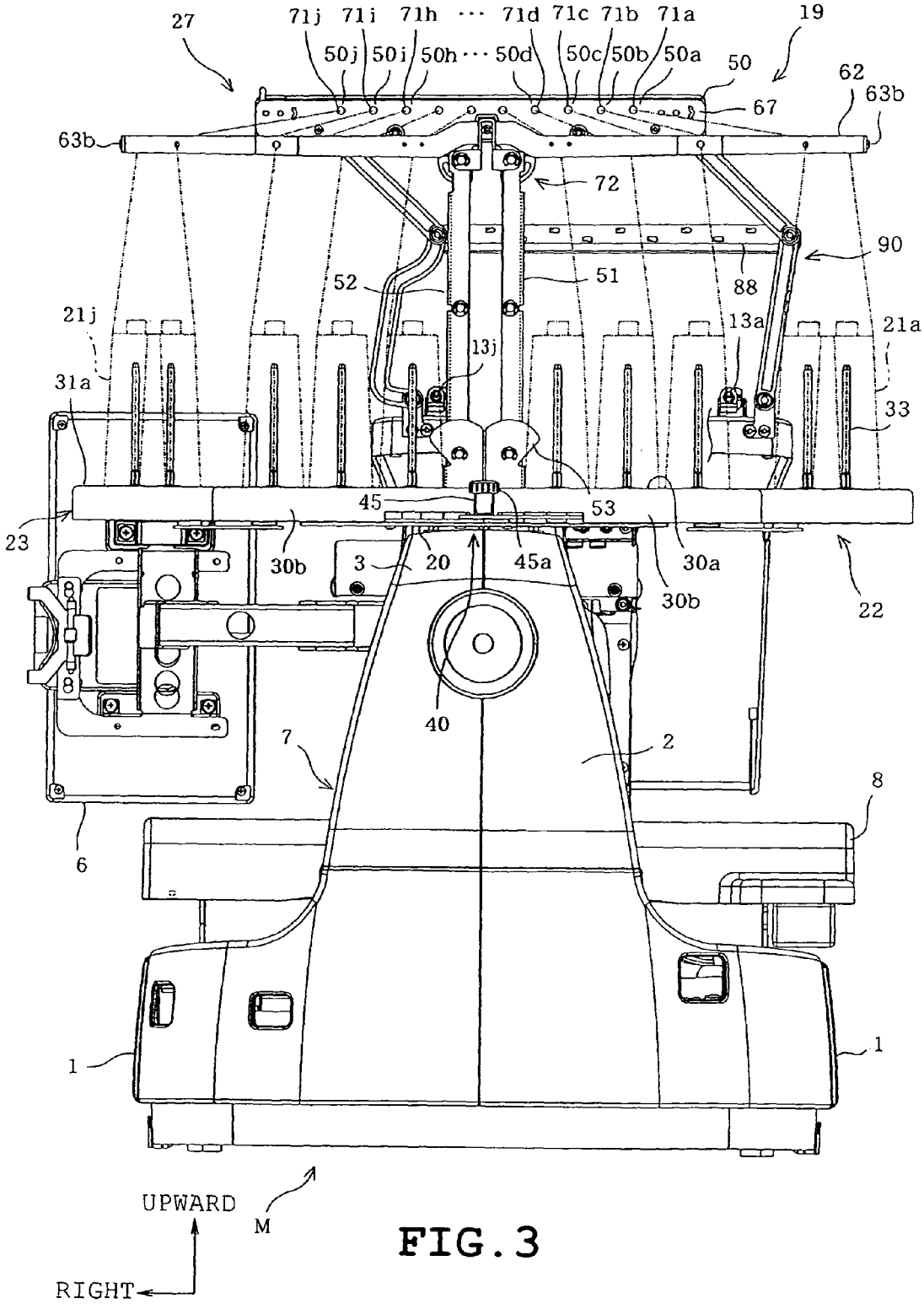
FIG. 3 is a rear view of the multi-needle sewing machine.
Figure 6:
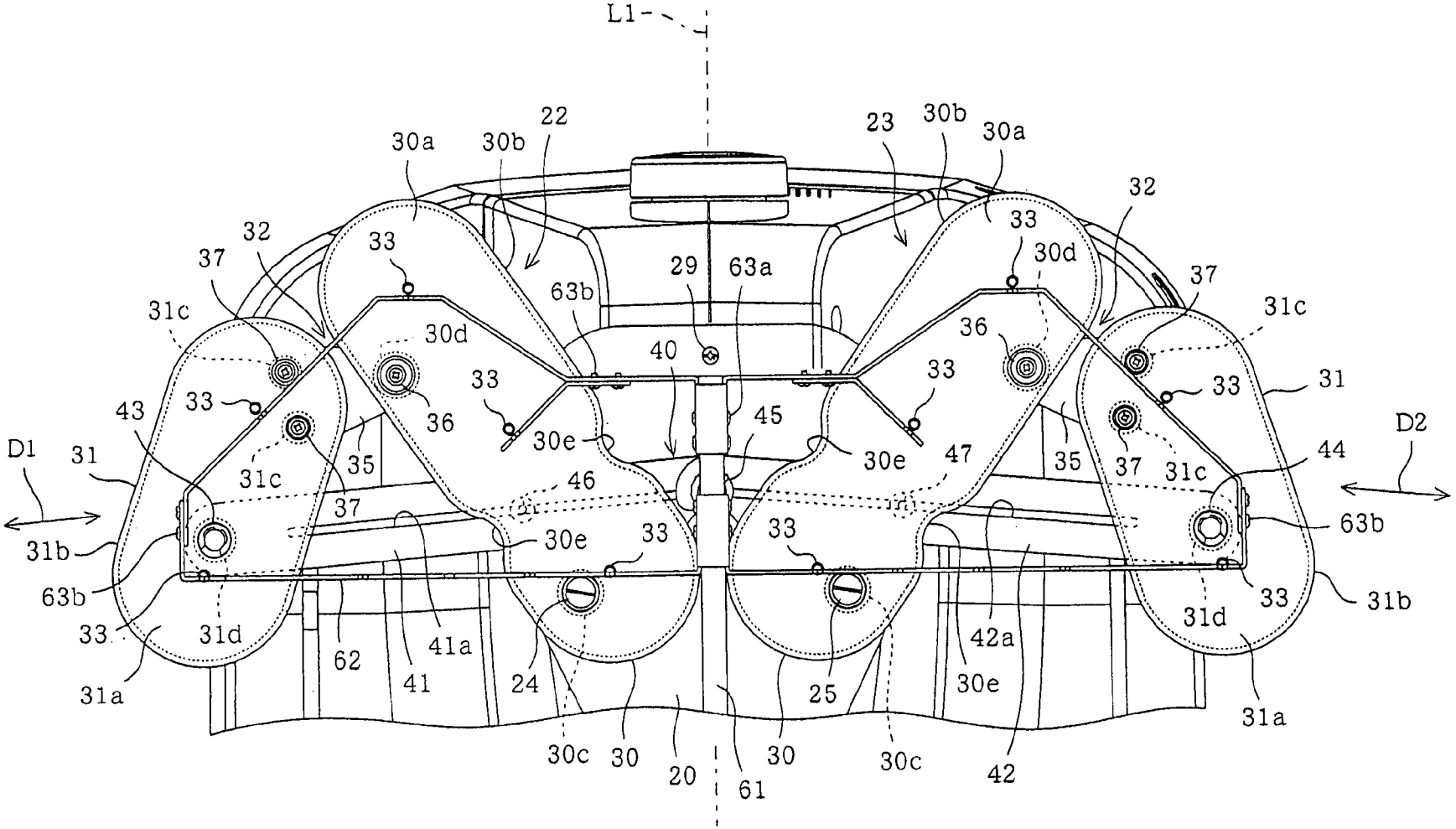
FIG. 6 is a plan view of a spool base.

The divided spool bracket 22 has first and second spool brackets 30 and 31 both made of a synthetic resin and a connecting part 32 connecting both spool brackets 30 and 31 as shown in FIGS. 4 and 6. More specifically, the first spool bracket 30 has a generally oval upper surface 30*a* as viewed in a plan view and a peripheral part 30*b* of the upper surface 30*a*. The upper surface 30*a* and the peripheral wall 30*b* are formed integrally with the first spool bracket 30. The peripheral wall 30*b* is formed so as to protrude downward from a peripheral edge of the upper surface 30*a* as shown in FIG. 3. For example, three spool pins 33 are mounted at predetermined intervals on the upper surface 30*a*. Three thread spools 21*c*, 21*d* and 21*e* are placed on the respective spool pins 33 so as to be horizontally arranged. The upper surface 30*a* has a front end formed with a support shaft hole 30*c* through which the support shaft 24 is inserted from above, as shown in FIG. 6. The upper surface 30*a* also has a rear end formed with a connecting hole 30*d* to which the connecting part 32 is connected. The first spool bracket 30 has a periphery formed with a pair of inwardly recessed escape portions 30*e* located near the front thereof.

The second spool bracket 31 also has a generally oval upper surface 31*a* and a peripheral wall 31*b* of the upper surface 31*a*. The upper surface 31*a* and the peripheral wall 31*b* are formed integrally with the second spool bracket 31. For example, two thread spools 21*a* and 21*b* are placed on the respective spool pins 33 so as to be horizontally arranged. The upper surface 31*a* has a rear end formed with a pair of connecting holes 31*c* to which the connecting part 32 is connected. The upper surface 31*a* also has a front end formed with a limiting hole 31*d* for connection of a limiting plate 41 which will be described later. The first spool bracket 30 is formed so that the escape portions 30*e* and the like are bilaterally symmetrical. The second spool bracket 31 is also formed so as to be bilaterally symmetrical. The first and second spool brackets 30 and 31 are co-used as the same component constituting the right and left divided spool brackets 22 and 23.

The first and second spool brackets 30 and 31 are provided with metal connecting plates 35 located in the back of the rears respectively. Each connecting plate 35 is connected to the first spool bracket 30 by a connecting shaft 36 inserted through the connecting hole 30*d*. Each connecting plate 35 is connected to the second spool bracket 31 by a pair of screws 37 inserted through the respective connecting holes 31*c*. The connecting plates 35, connecting shaft 36 and screws 37 constitute the connecting part 32. The second spool bracket 31 is connected via the connecting part 32 to the spool bracket 30 so as to be swingable around the connecting shaft 36.

The right divided spool bracket 23 has the same structure as the above-described left divided spool bracket 22. The right and left divided spool brackets 23 and 22 are disposed bilaterally symmetrically about the aforesaid line L1 serving as an axis of symmetry. The right divided spool bracket 23 also includes first and second spool bracket 30 and a connecting part 32 in the same manner as the left divided spool bracket 22. A plurality of thread spools 21*f* to 21*j* is placed on the right divided spool bracket 23. The first spool brackets 30 have support shaft holes 30*c* through which support shafts 24 and 25 are inserted, respectively. The divided spool brackets 22 and 23 are supported on the support bracket 20 by the support shafts 24 and 25 so as to be swingable.

The support bracket 20 includes a holding mechanism 40 which holds the divided spool brackets 22 and 23 at the aforementioned use position or the accommodation position. The holding mechanism 40 includes a pair of right and left limiting plates 42 and 41, a pair of continuous connecting shafts 43 and 44 which connect the second spool brackets 31 to the limiting plates 41 and 42 respectively, and a fastening member 45 which locks the limiting plates 41 and 42 (see FIG. 3). Each limiting plate 41, 42 is formed into the shape of an elongated plate. The limiting plates 41 and 42 have slits 41*a* and 42*a* formed along the lengthwise direction respectively. The fastening member 45 has a lower end formed with a threaded portion (not shown) and an upper end formed with a knob 45*a*. The lower end of the fastening member 45 is inserted through the slits 41*a* and 42*a* of the limiting plates 41 and 42 and screwed at the central portion of the support bracket 20. The fastening member 45 is located between the escape portions 30*e* of the first spool brackets 30 and 31 when the divided spool brackets 22 and 23 occupy the accommodated positions respectively.

When the knob 45*a* is turned in a predetermined direction, the fastening member 45 presses the limiting plates 41 and 42 between the support bracket 20 and the same, thereby fixing the limiting plates 41 and 42. When the knob 45*a* is turned in the reverse direction, the fastening member 45 releases the limiting plates 41 and 42 from the fastened state. Thus, the limiting plates 41 and 42 are locked on the support bracket 20 and released from the locked state by the single fastening member 45.

A pair of guide pins 46 and 47 are provided on the respective right and left sides of the support bracket 20 so as to be located in front of the fastening member 45 as shown by broken line in FIG. 6. The left limiting plate 41 is disposed so as to be movable substantially linearly in a predetermined direction as shown by arrow D1 relative to the support bracket 20 by the guide pin 46 and the fastening member 45. A limiting shaft 43 is inserted through a limiting plate hole 31*d* of the second spool bracket 31 in the left divided spool bracket 23. The second spool bracket 31 is connected to the left end of the left limiting plate 41 by the limiting shaft 43 so as to be swingable.

The guide pin 47 and the fastening member 45 are inserted through the slit 42*a* of the right limiting plate 42. The right limiting plate 42 is disposed so as to be movable substantially linearly in a predetermined direction as shown by arrow D2 relative to the support bracket 20 by the guide pin 47 and the fastening member 45. A limiting shaft 44 is inserted through a limiting plate hole 31*d* of the second spool bracket 31 in the left divided spool bracket 23. The second spool bracket 31 is connected to the right end of the right limiting plate 41 by the limiting shaft 44 so as to be swingable. The right limiting plate 42 is guided at the upper surface side of the left limiting plate 41 by the guide pin 47 although the structure therefor is not shown in detail. As a result, the limiting plates 41 and 42 can be prevented from interfering with each other when the divided spool brackets 22 and 23 are switched from the use position to the accommodation position.

When the divided spool brackets 22 and 23 are located at the accommodation position, the first and second spool brackets 30 and 31 become substantially parallel in the lengthwise direction thereby to be adjacent to each other. In this state, the divided spool brackets 22 and 23 are fixed by the knob 45*a* and the limiting plates 41 and 42. The fastening member 45 is loosened so that the divided spool brackets 22 and 23 are released from the fixed state. The first spool brackets 30 are swung about the support shafts 24 and 25, and the second spool brackets 31 are swung about the connecting shafts 36 respectively. The swing switches the first and second spool brackets 30 and 31 to the use position where the spool brackets 30 and 31 are expanded into the M-shape as viewed in a plan view. The limiting plates 41 and 42 limit the directions of movement of the second spool brackets 31. As the result of limitation by the limiting members, the divided spool brackets 22 and 23 can easily be switched between the accommodation position and the use position. Thus, the divided spool brackets 22 and 23 can be held at the accommodation position or use position by the fastening member 45.

The thread guide mechanism 27 will now be described with reference to FIGS. 8 to 10 as well as FIGS. 1 to 7. The thread guide mechanism 27 guides threads (needle threads T1 to T10) drawn from a plurality of thread spools 21*a* to 21*j* on the divided spool brackets 22 and 23 respectively. The thread guide mechanism 27 includes a thread guide member 50 extending substantially horizontally, a pair of divided support pillars 51 and 52 supporting the thread guide member 50 on the support bracket 20, and a base member 53 mounting the divided support pillars 51 and 52 onto the support bracket 20.

Figure 14A:
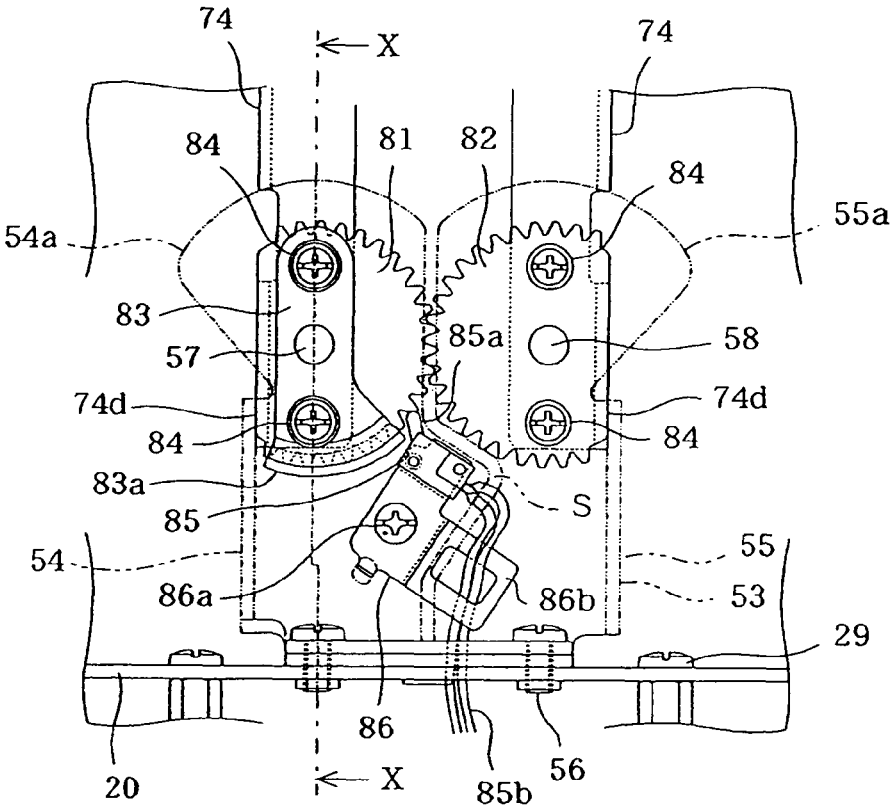
FIGS. 14A and 14B are enlarged front views of a base member and periphery in first and second positions of the divided support pillar respectively.

The base member 53 includes a pair of right and left mounting portions 54 and 55 having the same structure. The mounting portions 54 and 55 are disposed on the support bracket 20 so as to be symmetric about the aforementioned line L1. Each mounting portion 54, 55 is formed into a rectangular parallelepiped as viewed in a plan view. The mounting portions 54 and 55 have upper portions formed with sectorial covers 54*a* and 55*a* respectively. The mounting portions 54 and 55 have lower ends formed with flange-like mounting portions 54*b* and 55*b* respectively as shown in FIG. 10. Four fixing screws 56 extend through the mounting portions 54*b* and 55*b* placed one upon the other. The base member 53 is fixed to the front of the support bracket 20 by the screws 60. As shown in FIG. 14A, the right and left mounting portions 55 and 54 have respective fronts which define a crank-shaped space S therebetween. Alternatively, the mounting portions 54 and 55 may be close to each other without the space S.

Figure 9:
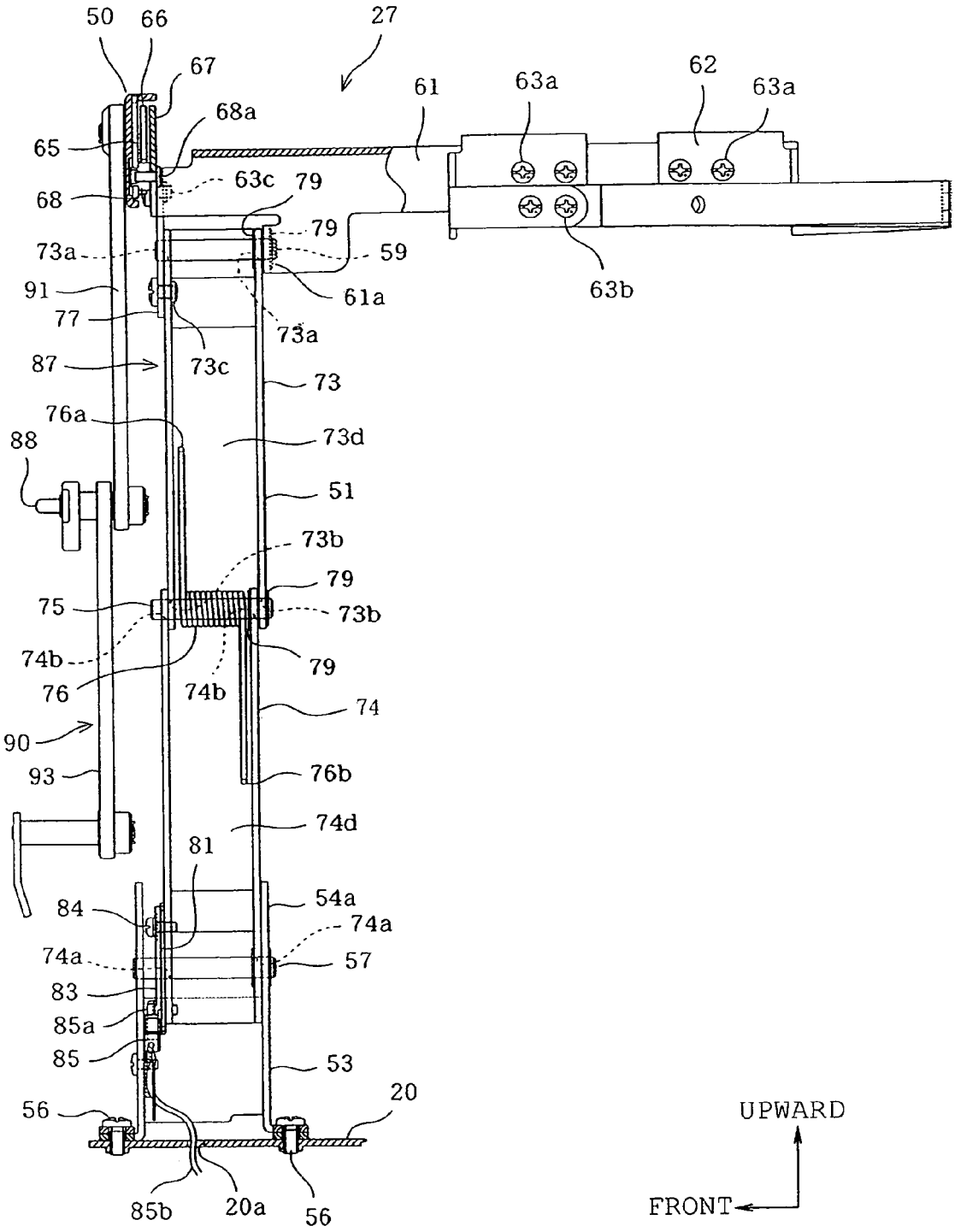
FIG. 9 is a section taken along line IX-IX in FIG. 8.

The divided support pillars 51 and 52 stand on the base member 53 as shown in FIG. 9. The divided support pillars 51 and 52 have respective upper ends on which thread guide member 50 is supported via a bridging member 61. The bridging member 61 extends rearward from upper ends of the divided support pillars 51 and 52. The bridging member 61 has a rear to which a threading member 62 is fixed by a screw 63*a*. The threading member 62 includes a plurality of bent plates connected by screws 63*b* as shown in FIG. 4. The threading member 62 has ten threading holes 62*a* to 62*j* located substantially right above the spool pins when the divided spool brackets 22, 23 are configured into the M-shape at the use position. The threading member 62 has a front side formed with auxiliary threading holes 62*b*' to 62*d*' and 62*g*' to 62*i*'. The needle threads T1 to T10 extending upward from the thread spools 21*a* to 21*j* are passed through the threading holes 62*a* to 62*j* and the auxiliary threading holes 62*b*' to 62*i*' thereby to be guided to the thread guide member 50 side without being entangled.

Figure 7:
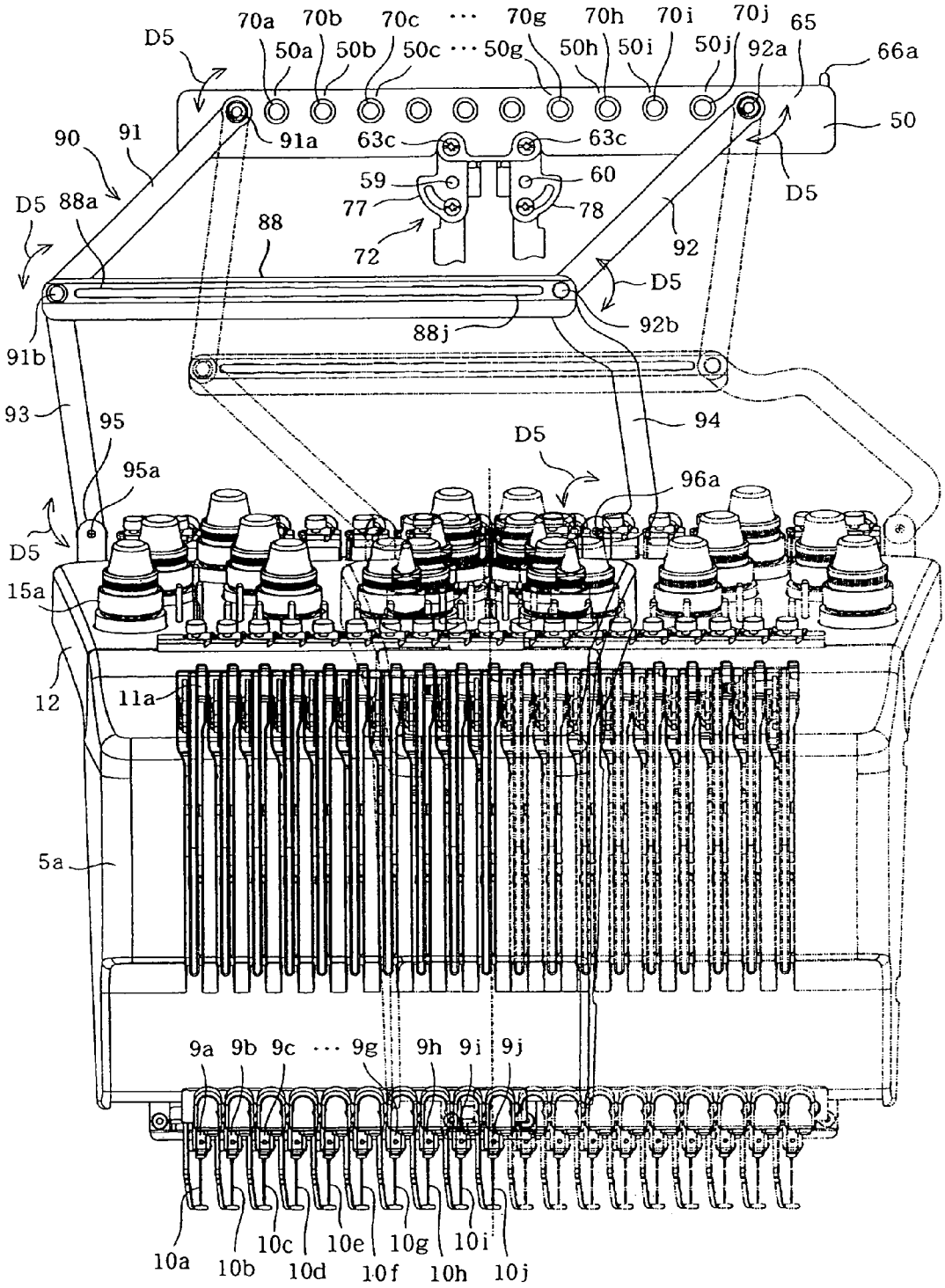
FIG. 7 is a front view of a part of the multi-needle sewing machine from a thread guide member to needles.
Figure 8:
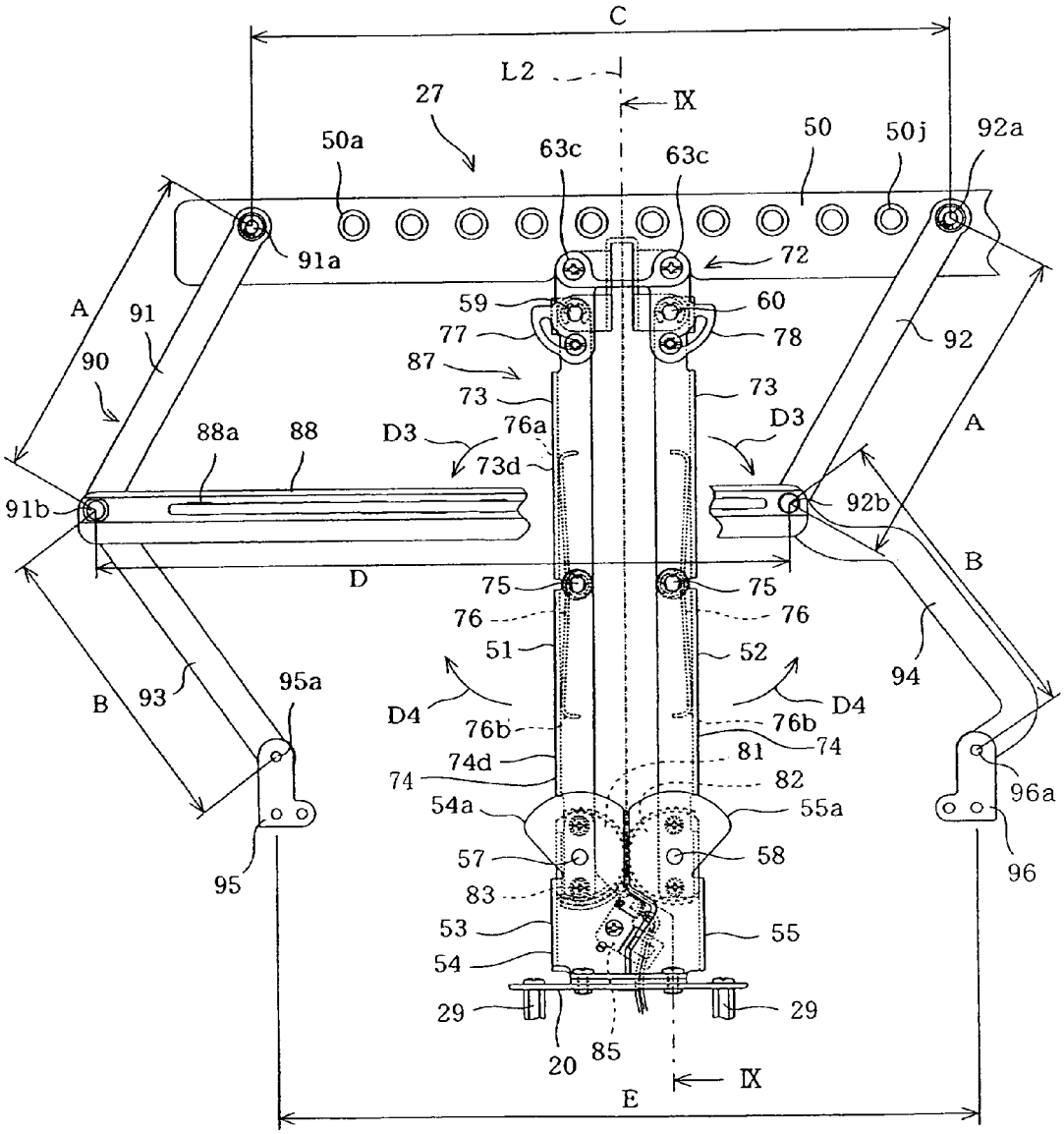
FIG. 8 is a front view of a thread guide mechanism and an intermediate thread guide link mechanism in a first position of a divided support pillar.

The bridging member 61 has a front end to which the lengthwise middle of the thread guide member 50 is fixed by a pair of screws 63*c* as shown in FIGS. 8 and 9. The thread guide member 50 has three elongate plate members 65, 66 and 67 (see FIGS. 3, 7 and 9) placed one upon another horizontally. Predetermined spaces are defined between the plate members 65 and 66 and between the plate members 66 and 67 so that the threads are passable in a bent state. A spacer 68 is provided between both outer plate members 65 and 67 so that the intermediate plate member 66 is movable, as shown in FIG. 9. The outer plate members 65 and 67 are fixed by screws 68*a*. The intermediate plate member 66 has an operation convex portion 66*a* which is formed on the right end thereof so as to protrude upward and which is formed integrally with the plate member 66. The intermediate plate member 66 is operable to be moved in the right-left direction relative to the outer plate members 65 and 67 by the spacer 68 and other guides (not shown).

The thread guide member 50 is provided with, for example, ten thread guides 50*a* to 50*j* which are lined substantially in the horizontal direction. The thread guides 50*a* to 50*j* include ten outer threading holes 70*a* to 70*j* formed in the front plate member 65 as shown in FIG. 7, ten outer threading holes 71*a* to 71*j* formed in the rear plate member 67 as shown in FIG. 3, and ten intermediate threading holes (not shown) formed in the intermediate plate member 66. The outer threading holes 70*a* to 70*j* and 71*a* to 71*j* are formed in the respective front and rear plate members 65 and 67 substantially at regular intervals so as to be located opposite each other. The intermediate threading holes are also formed in the intermediate plate member 66 at the same intervals as the outer threading holes 70*a*-70*j* and 71*a*-71*j*.

The intermediate plate member 66 is switched between a threading position and the use position during sewing by moving the intermediate plate member 66 by the operation convex portion 66*a*. When the plate member 66 is switched to the threading position, the intermediate threading holes positionally correspond with the outer threading holes 70*a*-70*j* and 71*a*-71*j*. When the plate member 66 is switched to the use position, the intermediate threading holes displaces in the right-left direction relative to the outer threading holes 70*a*-70*j* and 71*a*-71*j*. Accordingly, when the plate member 66 is located at the threading position, the needle threads T1 to T10 can be passed through the outer threading holes 70*a*-70*j* and 71*a*-71*j* and the intermediate threading holes. In the case where the intermediate plate member 66 is moved to the use position when the needle threads T1 to T10 have been passed sequentially through the outer threading holes 70*a*-70*j* and 71*a*-71*j* and the intermediate threading holes, the intermediate threading holes are displaced relative to the outer threading holes 70*a*-70*j* and 71*a*-71*j* such that the needle threads T1-T10 are bent.

Each divided support pillar 51, 52 is a supporting member which is divided into a plurality of parts. The line L2 in FIG. 8 extends vertically through the center of the sewing machine body 7. The two divided support pillars 51 and 52 have the same structure and are disposed bilaterally symmetrically about the line L2 serving as the axis of symmetry. Accordingly, only the left divided support pillar 51 will be described in the following. The divided support pillar 51 has an upper support pillar 73 and a lower support pillar 74. The upper support pillar 73 has an upper end that is swingably mounted on the thread guide member 50. The lower support pillar 74 has a lower end that is swingably mounted on the base member 53. The upper and lower support pillars 73 and 74 are made of a metal plate and formed into elongate shapes with the same length. Each support pillar 73, 74 has an open inside or line L2 side and accordingly has a concave section. The upper support pillar 73 has an upper end formed with a pair of front and rear pivot pin holes 73*a* and a lower end formed with a pair of front and rear connecting shaft holes 73*b*. The lower support pillar 74 has an upper end formed with a pair of front and rear connecting shaft holes 74*b* and a lower end formed with a pair of front and rear pivot pin holes 74*a*.

A connecting pin (connecting portion) 75 is inserted through the connecting shaft holes 73*b* and 74*b* which are connected back and forth, whereby the upper and lower support pillars 73 and 74 are connected by the connecting pin 75 so as to be swingable. The connecting pin 75 has a rear end where the connecting pin 75 is prevented from dropping out by a pair of retaining rings 79. A torsion coil spring 76 serving as an elastic member is provided around the periphery of the connecting pin 75. The torsion coil spring 76 has one end 76*a* locked by a sidewall 73*d* of the upper support pillar 73 and the other end 76*b* locked by a sidewall 74*d* of the lower support pillar 74. The torsion coil spring 76 urges the upper support pillar 73 in the direction of arrow D3 in FIG. 8 and the lower support pillar 74 in the direction of arrow D4 in FIG. 8.

Figure 12:
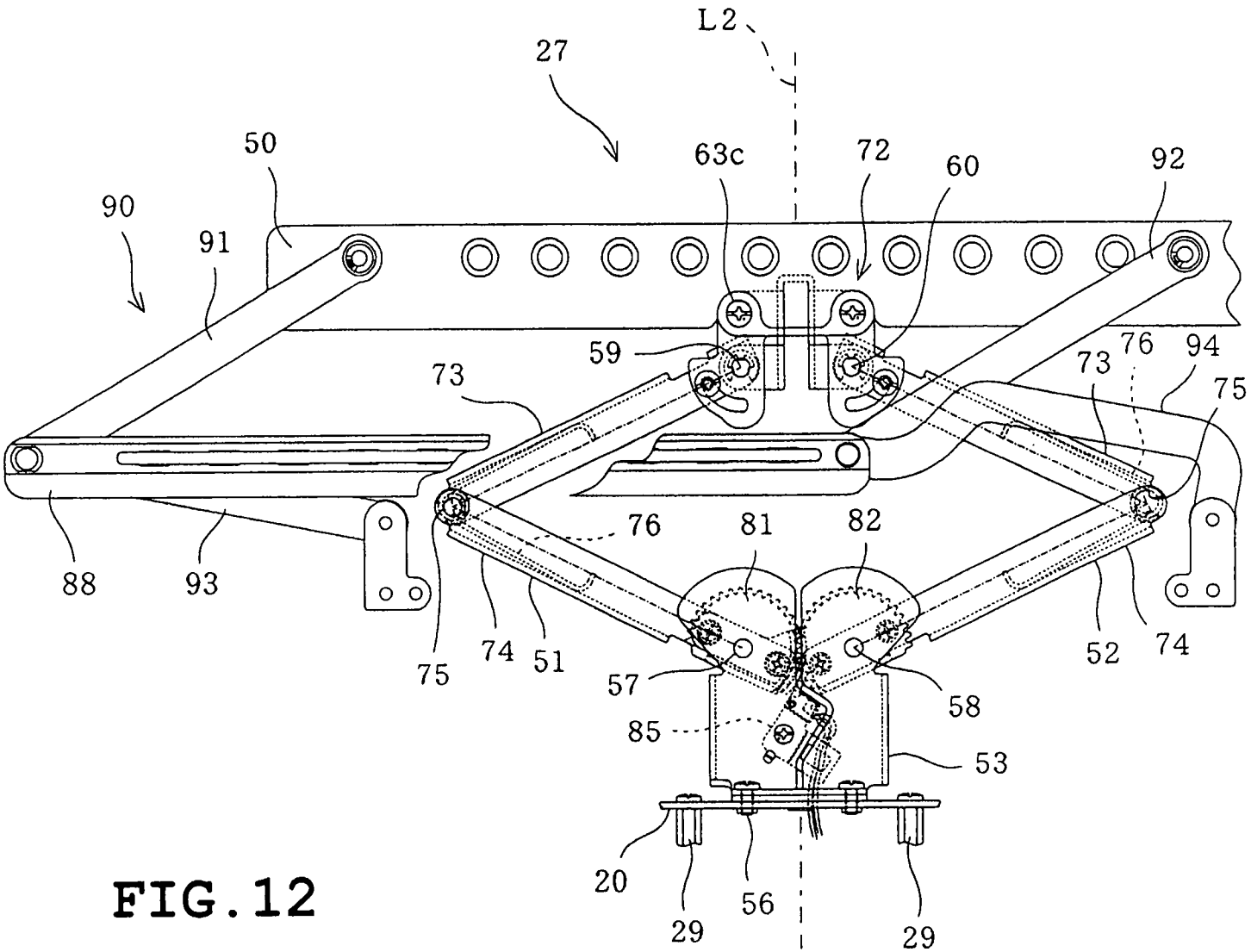
FIG. 12 is a view similar to FIG. 8, showing the state in a second position of the divided support pillar.

The right divided support pillar 52 has the same structure as the above-described divided support pillar 51, including the upper support pillar 73, the lower support pillar 74, the connecting pin 75 and the torsion coil spring 76. The right and left divided support pillars 52 and 51 are disposed bilaterally symmetrically about the line L2 serving as the axis of symmetry. The divided support pillars 51 and 52 have upper ends formed with pivot pin holes 73*a* through which upper pivot pins 59 and 60 are inserted, respectively. The divided support pillars 51 and 52 are mounted on the thread guide member 50 so as to be swingable by the upper pivot pins 59 and 60 respectively. The divided support pillars 51 and 52 have lower ends formed with pivot pin holes 74*a* through which the lower support pins 57 and 58 are inserted, respectively. The divided support pillars 51 and 52 are mounted on the base member 53 so as to be swingable about the lower pivot pins 57 and 58 respectively. Each of the divided support pillars 51 and 52 is switchable between a first position where the thread guide member 50 is located at an upper position during use as shown in FIG. 8 and a second position where the thread guide member 50 is located at an accommodation position during non-use as shown in FIG. 12. The upper support pillars 73 and the lower support pillars 74 are substantially vertically lined when the divided support pillars 51 and 52 are located at the first position. The upper and lower support pillars 73 and 74 are bent at the connecting pin 75 when the divided support pillars 51 and 52 are located at the second position.

A mounting structure for the upper and lower ends of the divided support pillars 51 and 52 will now be described with reference to FIGS. 13A to 14B as well as FIGS. 1 to 12. Two locking plates 77 and 78 having right and left sectorial portions are disposed on the upper ends of the upper support pillars 73, respectively. Each of the right and left locking plates 78 and 77 is made of a metal plate and formed bilaterally symmetrically. The left locking plate 77 has an arc-shaped guide groove 77*a* formed along the sectorial portion of lower half thereof. The locking plate 77 also has a pivot pin hole 77*b* formed substantially in the center of the arc-shaped guide groove 77*a* thereof. The right locking plate 78 also has an arc-shaped guide groove 78*a* and a pivot pin hole 78*b* in the same manner as the left locking plate 78. The locking plates 77 and 78 are disposed along the rear side of the thread guide member 50 and the front side of the divided support pillars 51 and 52 as shown in FIG. 9. The locking plates 77 and 78 are then fixed to a front end of the bridging member 61 by a pair of screws 63*c*.

Figure 13A:
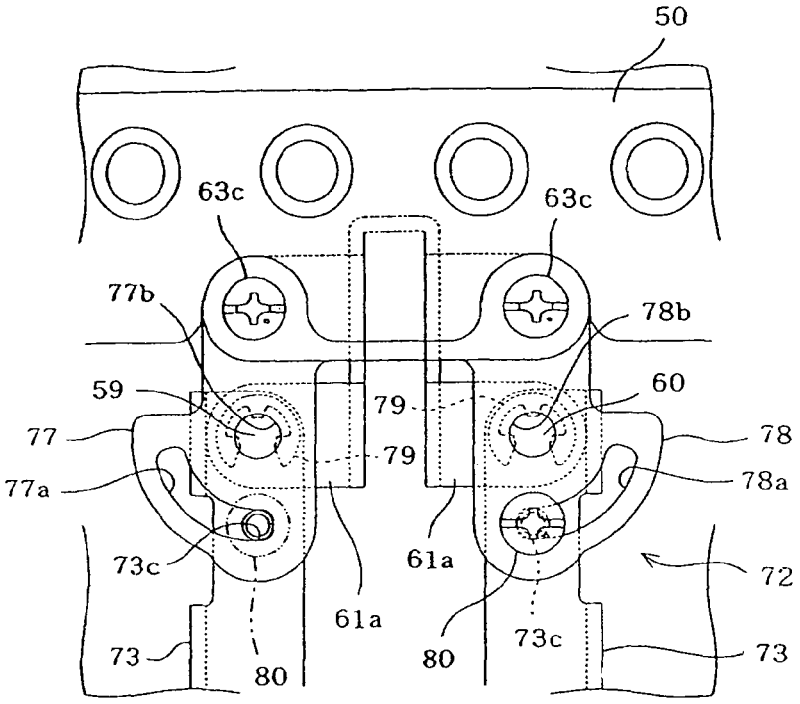
FIGS. 13A and 13B are enlarged front views of a swing locking unit and periphery thereof in the first and second positions of the divided support pillar.

The bridging member 61 has a pair of pivot pin attaching portions 61*a* formed integrally in the lower front thereof as shown in FIGS. 9 and 13A. The upper pivot pins 59 and 60 are inserted through the attaching portions 61*a* and further through the pivot pin holes 73*a* of the divided support pillars 51 and 52 and the pivot pin holes 77*b* and 78*b* of the locking plates 77 and 78. A pair of retaining rings 79 are attached to rear ends of the upper pivot pins 59 and 60 to prevent the pins 59 and 60 from dropping out, respectively.

The upper support pillars 73 have upper ends including parts which face the guide grooves 77*a* and 78*a* of the locking plates 77 and 78 and are provided with female threads 73*c*, respectively. The female threads 73*c* are formed by a burring process. Locking screws 80 inserted through the guide grooves 77*a* and 78*a* are screwed shut by the female threads 73*c* respectively. The upper support pillars 73 are fastened by the locking screws 80 thereby to be fixed. Consequently, the upper support pillars 73 are prevented from swinging relative to the thread guide member 50. A swing preventing unit 72 is thus constituted by the locking plates 77 and 78, the paired locking screws 80 and the female screws 73*c*. The swing preventing unit 72 can retain the divided support pillars 51 and 52 in desired positions by fixing the locking screws 80. When the locking screws 80 are loosened, the upper support pillars 73 can be released from the locked state. In the released state, the positions of the divided support pillars 51 and 52 can be changed. When the locking screws 80 abut both ends of the inner walls of the guide grooves 78*a*, ranges of swinging of the upper support pillars 73 are limited. The locking screws 80 are abutted against both ends of the inner walls of the guide grooves 77*a* and 78*a* so that the divided support pillars 51 and 52 are switched between the aforesaid first and second positions. The swing preventing unit 72 and torsion coil spring 76 constitute a holding device 87 serving as a retaining unit.

Figure 10:
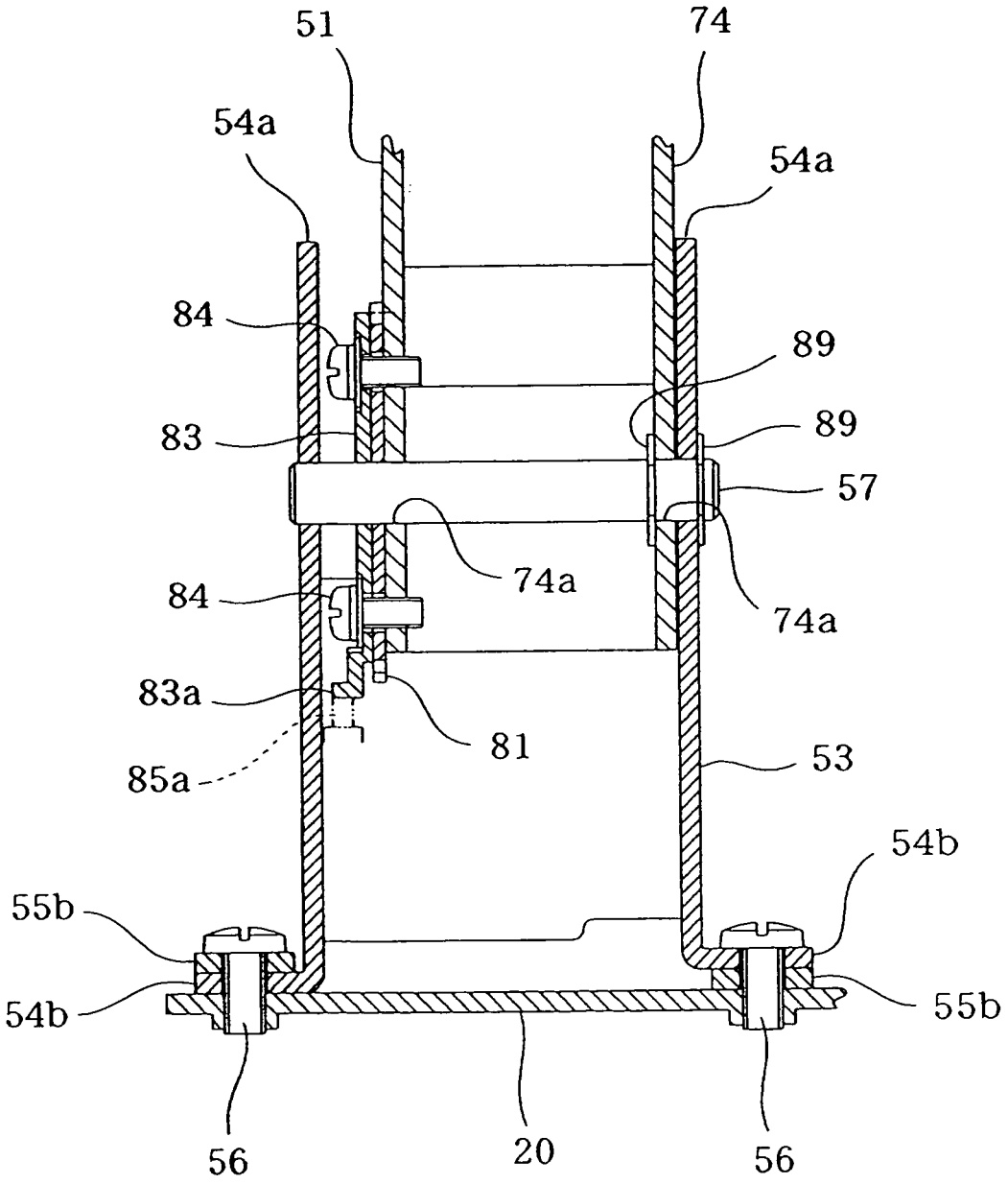
FIG. 10 is an enlarged section taken along line X-X in FIG. 14A.

A pair of sector gears 81 and 82 are provided on the lower ends of the paired lower support pillars 74 respectively as shown in FIGS. 10 and 14. The sector gears 81 and 82 are disposed in bilateral symmetry so as to be brought into mesh engagement with each other. More specifically, the sector gear 81 and a cam plate 83 in an overlapped state are fixed to the front side of the left lower support pillar 74 by a pair of screws 84. The sector gear 81 is formed into an arc shape with the central axis of the lower pivot pin 57 serving as a center. The cam plate 83 has an arc-shaped cam portion 83*a* in a lower half thereof as viewed in a front view. The cam portion 83*a* juts along the outer periphery of the sector gear 81 as viewed in a front view. The cam portion 83*a* has an outer edge which is formed so as to be bent into the shape of a forwardly protruding step as shown in FIG. 10. The lower pivot pin 57 to be inserted through the pivot pin hole 74*a* in the left lower support pillar 74 is provided so as to be passed through the sector gear 81, the cam plate 83 and the base 53 in the front-rear direction.

The sector gear 82 is fixed to the front side of the right lower support pillar 74 by a pair of screws 84. The sector gear 82 is formed into an arc shape with the central axis of the lower pivot pin 58 serving as a center. In the right lower support pillar 74, the lower pivot pin 58 to be inserted through the pivot pin hole 74*a* is provided so as to be passed through the sector gear 82 and the base member 53 in the front-rear direction. The lower pivot pins 57 and 58 have respective rear ends which are prevented from dropping out by a pair of retaining rings 89 as shown in FIG. 10.

Figure 14B:
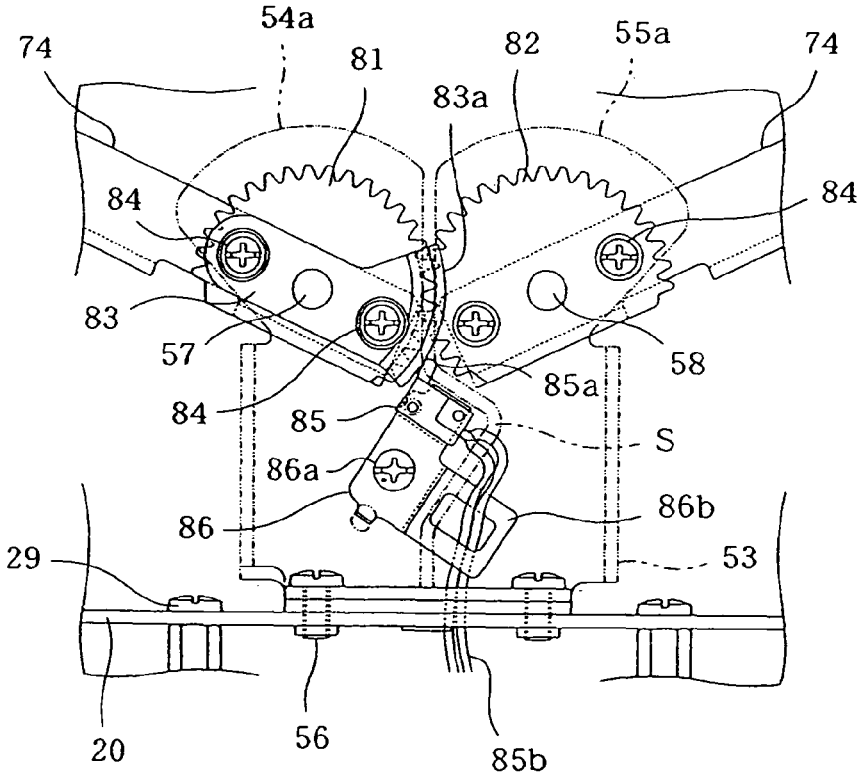

The sector gears 81 and 82 are formed so as to have an equal pitch diameter. The right and left lower support pillars 74 are swung symmetrically about the lower pivot pins 57 and 58 by the mesh engagement of the sector gears 81 and 82. The front sides of the sector gears 81 and 82 are covered by the covers 54*a* and 55*a* provided on the upper part of the base member 53. As shown in FIGS. 14A and 14B, the sector gears 81 and 82 are prevented from exposing during swinging of the lower support pillars 74. On this occasion, the sidewalls 74*d* of the lower support pillars 74 abut the inner walls of the base member 53, thereby limiting the swinging range of the lower support pillars 74 as shown in FIG. 14A.

A detection switch 85 and a switch holder 86 holding the detection switch 85 are enclosed in the base member 53. The switch holder 86 is fixed by a screw 86*a* while the detection switch 85 is disposed along the above-mentioned space S. The detection switch 85 has a detection lever 85*a* which can be brought into sliding contact with an outer periphery of the cam portion 83*a*. The detection lever 85*a* is brought into contact with or departed from the outer edge of the cam portion 83*a* during swinging of the lower support pillar 74. With this, the detection lever 85*a* is actuated in one direction. The detection switch 85 is turned on or off by the actuation of the detection lever 85*a* in a predetermined direction. The detection switch 85 serves as a detecting unit which detects the first or second positions of the divided support pillars 51 and 52. FIG. 14A shows a part of a lead wire 85*b* of the detection switch 85. The lead wire 85*b* delivers an on-off signal of the detection switch 85. A switch holder 85 includes a lead wire holder portion 86*b* through which the lead wire 85*b* is passed. The support bracket 20 is formed with a through hole 20*a* from which the lead wire 85*b* is drawn out to the sewing machine body 7 side thereby to be connected to a control device 18, as shown in FIG. 9.

An intermediate thread guide member 88 is disposed between the thread guide portions 50*a* to 50*j* and the thread entrances 13*a* to 13*j* as shown in FIGS. 5 and 7. The intermediate thread guide member 88 has ten intermediate thread guide portions 88*a* to 88*j*. Each of the intermediate thread guide portions 88*a* to 88*j* is formed into a rounded hole and extends vertically through the intermediate thread guide member 88. The intermediate thread guide portions 88*a* to 88*j* are lined substantially in the horizontal direction at the same pitch as the thread guide portions 50*a*-50*j* or the thread entrances 13*a* to 13*j*.

The needle bar case 5 is moved together with the thread entrances 13*a* to 13*j*. As shown in FIG. 7, the intermediate thread guide member 88 is moved by an intermediate thread guide link mechanism 90 according to an amount of movement of the needle bar case 5. The intermediate thread guide link mechanism 90 includes a pair of first link members 91 and 92 and a pair of second link members 93 and 94. The first link members 91 and 92 connect the thread guide member 50 and the intermediate thread guide member 88, and the second link members 93 and 94 connect the intermediate thread guide member 88 and the rear end of the thread tension bracket 12.

The left first link member 91 has an upper end which is mounted on a pivot pin 91*a* further mounted on a left end of the thread guide member 50 so that the link member 91 is pivotable in the direction of arrow D5 in FIG. 7. The first link member 91 also has a lower end which is mounted on a pivot pin 91*b* further mounted on a left end of the intermediate thread guide member 88 so that the link member 91 is pivotable in the direction of arrow D5. The right first link member 92 has an upper end which is mounted on a pivot pin 92*a* further mounted on a right end of the thread guide member 50 so that the link member 92 is pivotable in the direction of arrow D5. The right first link member 92 has the other end which is mounted on a pivot pin 92*b* further mounted on a right end of the intermediate thread guide member 88 so that the link member 92 is pivotable in the direction of arrow D5. The first link members 91 and 92 are set to the same link length A as shown in FIG. 8. In other words, a distance between the link fulcrum points 91*a* and 91*b* is equal to a distance between the link fulcrum points 92*a* and 92*b*. The needle bar case 5 has a left end provided with a support piece 95 located near the thread entrance 13*a* and a right end provided with a support piece 96 located near the thread entrance 13*j*, as shown in FIG. 7.

The left second link member 93 has a lower end which is mounted on a support shaft 95*a* further mounted on the support piece 95 so that the link member 93 is pivotable in the direction of arrow D5 in FIG. 7. The left second link member 93 has an upper end which is mounted on the pin 91*b* further mounted on a left end of the intermediate thread guide member 88 so that the link member 93 is pivotable in the direction of arrow D5. The right second link member 94 has a lower end which is mounted on a support shaft 96*a* further mounted on the support piece 96 so that the link member 94 is pivotable in the direction of arrow 5. The right second link member 94 has an upper end which is mounted on the pin 92*b* further mounted on a right end of the intermediate thread guide member 88 so that the link member 94 is pivotable in the direction of arrow 5. Only the second link member 94 is formed substantially into an arcuate shape as viewed in a front view and the other link members 91 to 93 are formed into a linear shape. The second link members 93 and 94 are set to the same link length B. In other words, a distance between the link fulcrum points 95*a* and 91*b* is equal to a distance between the link fulcrum points 96*a* and 92*b*. A distance C between the pins 91*a* and 92*a*, a distance D between the pins 91*b* and 92*b* and a distance E between the support shafts 95*a* and 96*a* are set so as to be equal to one another. As a result, the link members 91 to 94 and the intermediate thread guide member 88 constitute a parallel link mechanism with the link lengths A and B.

The needle threads T1 to T10 extend upward from the thread spools 21*a* to 21*j* in the thread holder 19. The needle threads T1 to T10 are passed sequentially through threading holes 62*a* to 62*j* of the thread guide mechanism 27, thread guides 50*a* to 50*j* and the intermediate thread guides 88*a* to 88*j*, being introduced into the thread entrances 13*a* to 13*j*, respectively. The needle threads T1 to T10 having been introduced into the thread entrances 13*a*-13*j* are then passed through a predetermined thread feed passage. More specifically, the needle threads T1-T10 are passed sequentially through auxiliary thread guides 14*a* to 14*j*, the thread tensioners 15*a* to 15*j*, the thread take-up levers 11*a* to 11*j* and the like, thereafter being inserted through eyes (not shown) of the needles 10*a* to 10*j* respectively. The needle threads T1-T10 are guided between the thread guides 50*a*-50*j*, the intermediate thread guides 88*a*-88*j* and the thread entrances 13*a*-13*j* so as to extend in parallel with one another as shown in FIG. 1. The intermediate thread guides 88*a*-88*j* are also moved with movement of the needle bar case 5 relative to the thread guide member 50. As shown in FIG. 7, the movement of the intermediate thread guides 88*a*-88*j* is a parallel movement by the intermediate thread guide link mechanism 90 in the direction of alignment of the thread guides 50*a*-50*j* or in the direction of alignment of the thread entrances 13*a*-13*j*. Accordingly, an occurrence of thread entanglement can be prevented by the action of the intermediate thread guide link mechanism 90 even when the needle bar case 5 is moved together with the thread entrances 13*a*-13*j*.

An arrangement of the control system of the sewing machine will now be described with reference to the block diagram of FIG. 11. The control device 18 is mainly composed of a microcomputer and includes a CPU 18*a*, a ROM 18*b*, a RAM 18*c*, an EEPROM 18*d*, an input/output interface (I/O) 18*e*, a bus 18*f* connecting these components, and the like. To the I/O 18*e* are connected a start/stop switch 6*b*, a card connector 6*d*, a touch panel 6*e* and a detection switch 85. To the I/O 18*f* are further connected a drive circuit 101 for driving the sewing machine motor 16, a drive circuit 102 for driving the needle bar case moving motor 17, a drive circuit 103 for driving the liquid crystal display 6*a* and a drive circuit 104 for driving the buzzer 6*c*. The control device 18 informs the user of the positions of the divided support pillars 51 and 52 based on the results of detection by the detection switch 85. The informing is executed by the liquid crystal display 6*a* or the buzzer 6*c*. Thus, an informing unit is constituted by the control device 18, the liquid crystal display 6*a*, the buzzer 6*c* and the drive circuits 103 and 104.

The detection switch 85 is turned on as shown in FIG. 14A with the switching of the divided support pillars 51 and 52 to the first position. Only when the detection switch 85 is turned on, the control device 18 allows the needle bar case drive motor 17 to be driven. The ROM 18*b* stores a sewing control program and the like. The RAM 18*c* is provided with necessary memories. The memories include buffers and counters both of which are necessary for execution of various control manners. The control device 18 controls various actuators such as the sewing machine motor 16 according to the sewing control program thereby to execute a sewing operation on a workpiece cloth.

Figure 13B:
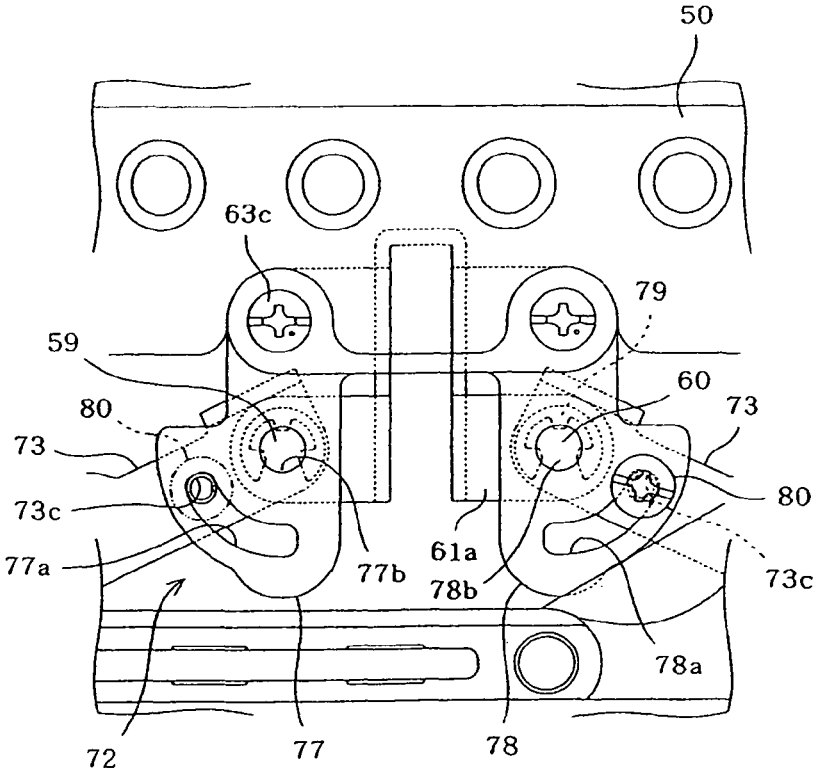
Figure 15:
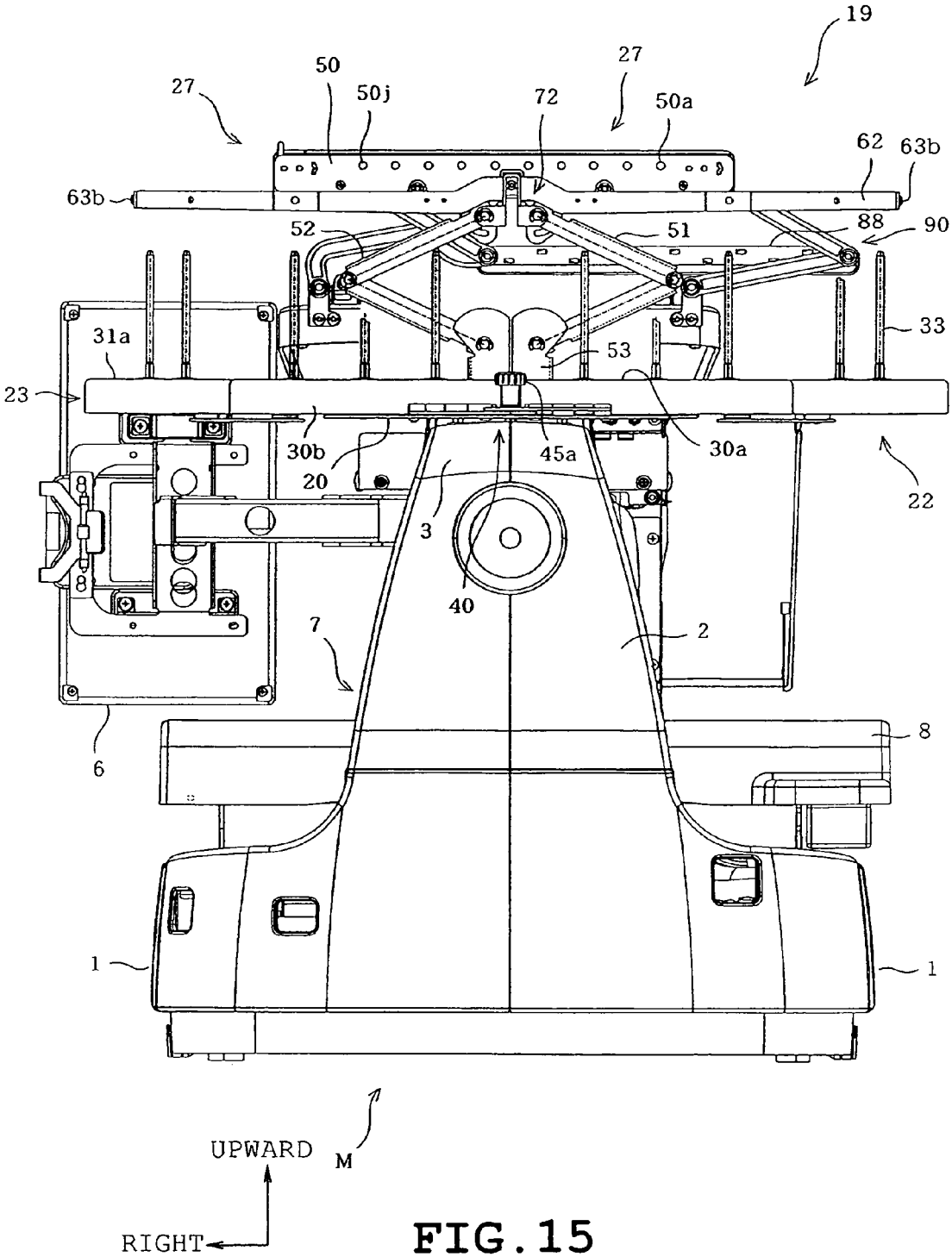
FIG. 15 is a view similar to FIG. 3, showing the state in the second position of the divided support pillar.

The above-described construction will work as follows. As shown in FIGS. 12 and 15, when the divided support pillars 51 and 52 assumes the second position, the thread guide member 50 in the spool holder is located at an accommodation location near the support base 20 side, which location is indicative of non-use. The intermediate thread guide 88 and the intermediate thread guide link mechanism 90 are also located at respective accommodation locations. In this state, the divided support pillars 51 and 52 are fixed at the locking plates 77 and 78 by the paired locking screws 80 respectively as shown in FIG. 13B. As a result, the aforesaid accommodation location is retained by the fixing by the locking screw 80. The detection lever 85*a* is in contact with the outer edge of the cam portion 83*a* such that the detection switch 85 is turned off, as shown in FIG. 14B.

Before start of the sewing, the control device 18 prompts the user to switch the divided support pillars 51 and 52 to the second position, based on an off-signal of the detection switch 85. This is carried out by displaying a design (not shown) of the second position of the divided support pillars 51 and 52. Characters indicative of the second position may be used instead of the design. Assume now that the user operates the start/stop switch 6*b* to start sewing when the divided support pillars 51 and 52 are in the second position. In this case, the control device 18 activates the buzzer 6*c*, based on the ON signal of the detection switch 85, thereby informing the user of the second position of the divided support pillars 51 and 52. The control device 18 controls the needle bar case moving motor 17 so that the motor 17 is not driven, based on the OFF signal. More specifically, the intermediate thread guide link mechanism 90 connecting the thread guide member 50 and the needle bar case 5 blocks the movement of the needle bar case 5 when the thread guide member 50 is located at the accommodation location. The control device 18 controls the motor 17 and carries out the aforesaid informing in order that a reaction force blocking the movement of the needle bar case 5 may not result in a problem of overload or the like due to drive of the motor 17. Alternatively, sound may be produced from a loud speaker (not shown) instead of activation of the buzzer.

The user loosens the locking screws 80 to release the divided support pillars 51 and 52 from the fixed state when the divided support pillars 51 and 52 are switched to the first position. The divided support pillars 51 and 52 are switched form the second position to the first position, and the thread guide member 50 is moved from the accommodation location to an upper location above the thread spools 21*a*-21*j*. In the switching, the lower support pillars 74 are swung bilaterally symmetrically about the lower pivot pins 57 and 58 as the result of mesh engagement of the sector gears 81 and 82. The upper support pillars 73 are also swung bilaterally symmetrically about the upper pivot pins 59 and 60. The upper and lower support pillars 73 and 74 are swung until the pillars 73 and 74 assume the first position where the pillars 73 and 74 are vertically aligned. The divided support pillars 51 and 52 are fixed at the locking plates 77 and 78 by the paired locking screws 80 respectively when assuming the first position. As a result, the divided support pillars 51 and 52 can reliably be held in the first position. As shown in FIG. 14A, when or, more specifically, immediately before the pillars 51 and 52 are switched to the first position, the detection switch 85 is turned on with separation of the detection lever 85*a* from the outer edge of the cam portion 83*a*. The control device 18 switches to the first position the design of the divided support pillars 51 and 52 on the liquid crystal display 6*a*, based on an ON signal of the detection switch 85. The control device 18 further allows the drive of the motor 17 and a sewing operation by the sewing machine M, based on the aforementioned ON signal.

After completion of sewing, the paired locking screws 80 of the locking plates 77 and 78 are loosened. The upper and lower support pillars 73 and 74 are normally urged in the directions of arrows D3 and D4 by the torsion coil spring 76. Accordingly, even when the locking screws 80 are loosened, the urging force of the torsion coil spring 76 prevents the thread guide member 50 from sudden fall due to self-weight. The divided support pillars 51 and 52 are switchable from the first position to the second position while the locking screws 80 are loosened. The upper support pillars 73 are re-fixed to the locking plates 77 and 78 by the locking screws 80 respectively when the divided support pillars 51 and 52 assume an intermediate position between the first and second positions. Thus, the divided support pillars 51 and 52 can be held in a desired position. The upper and lower support pillars 73 and 74 are bent at the connections (around connecting pins 75).

The spool holder 19 described heretofore includes the holding device 87 which holds the divided support pillars 51 and 52 so that the pillars 51 and 52 are switchable between the first and second positions. According to the spool holder 19, the threads can be guided by the thread guide member 50 at the location higher than the thread spools 21*a*-21*j* when the divided support pillars 51 and 52 assume the first position in use. The divided support pillars 51 and 52 are switched to the second position only by bending the upper and lower support pillars 73 and 74 at the connections in non-use. The thread guide member 50 is moved to the accommodation position relative to the support base 20 when the pillars 51 and 52 are in the second position. Consequently, the spool holder 19 can easily be carried and accommodated without being bulky. The holding device 87 holds the position of the divided support pillars 51 and 52 and accordingly the location of the thread guide member 50. The thread guide member 50 can be prevented from inadvertent movement and accordingly, the needle threads T1-T10 can properly be guided.

The upper and lower support pillars 73 and 74 are set substantially to the same length. When having been switched to the second position, the divided support pillars 51 and 52 can be bent at the connections so as to be folded into about a half length. Consequently, the overall length of the bent divided support pillars 51 and 52 can be rendered as short as possible, and the pillars 51 and 52 can be stowed away in a smaller feature size.

The support pillar supporting the thread guide member 50 comprises the paired divided support pillars 51 and 52 disposed bilaterally symmetrically on the support base 20. The divided support pillars 51 and 52 includes the upper support pillars 73 having the upper ends which support substantially the lengthwise middle of the thread guide member 50. Consequently, the thread guide member 50 can be held substantially horizontally while the pillars 51 and 52 are assuming the first position where the pillars are in parallel to each other. Since the lengthwise middle of the thread guide member 50 is supported by the two divided support pillars 51 and 52, the thread guide member 50 can be supported more stably.

The lower support pillars 74 are swung symmetrically about the respective lower ends by the mesh engagement of the gears 81 and 82. The two divided support pillars 51 and 52 are switched between the first and second positions with swing of the lower support pillars 74. The thread guide member 50 can normally be supported in a horizontal state since the divided support pillars 51 and 52 are switched between the first and second positions while retaining the lateral symmetry. The divided support pillars 51 and 52 are in such a positional relationship as to face each other. Accordingly, the divided support pillars 51 and 52 can be bent evenly when assuming the second position. Consequently, the pillars 51 and 52 can be stowed away in a further smaller feature size.

The holding device 87 includes the torsion coil springs 76 which elastically urge the upper and lower support pillars 73 and 74 so that the pillars 73 and 74 assume the first position and the swing locking unit 72 which can lock the upper support pillars 73 being swung relative to the thread guide member 50. The thread guide member 50 can reliably be held at a predetermined height. The torsion coil spring 76 is provided about the connecting pin 75 to urge both support pillars 73 and 74. When the upper support pillars 73 are released from locked state by the swing locking unit 72, the urging force of the torsion coil spring 76 can prevent the thread guide member 50 from sudden fall due to self-weight.

The swinging upper support pillars 73 are locked by the swing locking unit 72 so that the divided support pillars 51 and 52 are held in the intermediate position. As the intermediate position of the pillars 51 and 52, for example, the thread guide member 50 is held at a desired position slightly lower than an upper position. Consequently, the usability of the spool holder can be improved since the spool holder 19 can be carried with the pillars 51 and 52 being retained at the intermediate position.

The spool holder 19 includes the detection switch 85 which detects the first or second position of the divided support pillars 51 and 52. The control device 18, serving as the informing unit, informs the user of the position of the divided support pillars 51 and 52, based on the results of detection by the detection switch 85. For example, even when the user forgets to switch the thread guide member 50 to the upper position, the control device 18 informs the user of the second position of the divided support pillars 51 and 52. This can reliably prevent an erroneous operation that the multi-needle sewing machine executes a sewing operation with the thread guide member 50 remaining at the accommodation position.

Second Embodiment

Figure 16A:
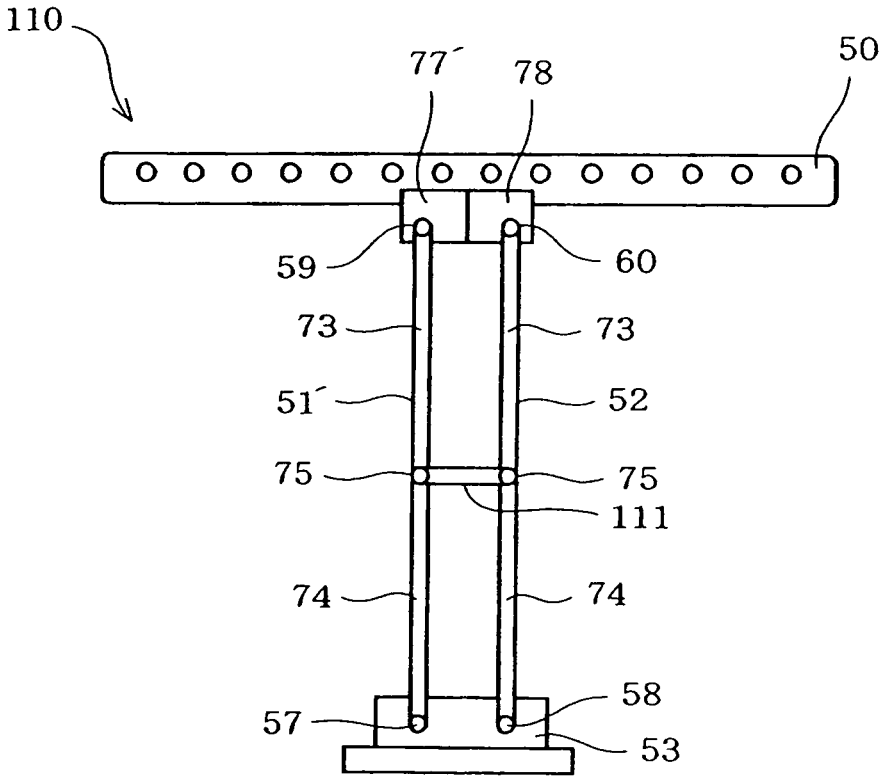
FIGS. 16A and 16B are schematic views of the thread guide mechanism in the first and second positions of the divided support pillar in a second example.
Figure 16B:
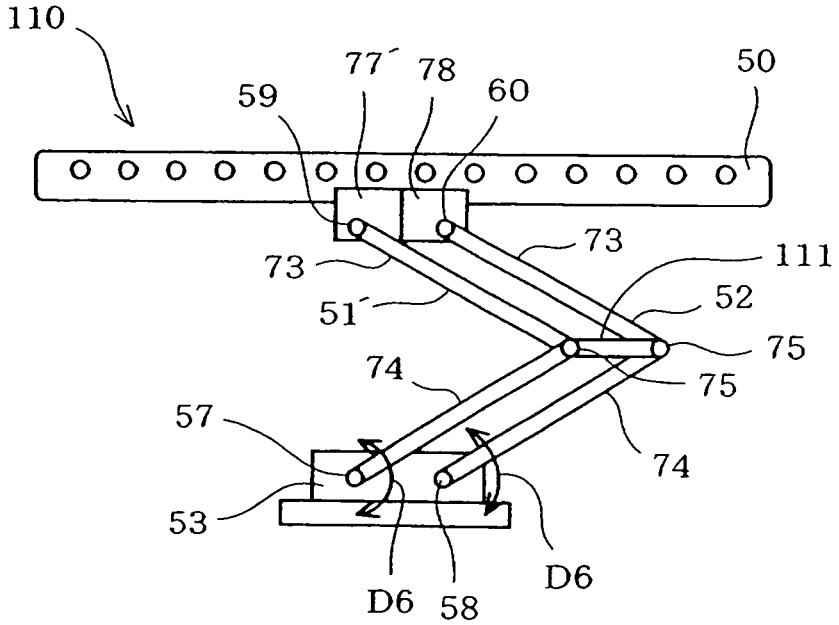

FIGS. 16A and 16B illustrate a second embodiment. Only the difference of the second embodiment from the first embodiment will be described. In FIGS. 16A and 16B, identical or similar parts in the second embodiment are labeled by the same reference symbols as those in the first embodiment.

The thread guide mechanism 110 in the second embodiment differs from the thread guide mechanism 27 in the first embodiment in the following respects. The thread guide mechanism 110 includes two divided support pillars 51' and 52. The left divided support pillar 51' has the upper support pillar 73, the lower support pillar 74, the connecting pin 75 and the torsion coil spring 76 in the same manner as the divided support pillar 51 in the first embodiment. The left divided support pillar 51' is swingably mounted between the upper and lower pivot pins 59 and 57 while being placed back to front by turning 180 degrees. The locking plate 77' mounted on the upper part of the left divided support pillar 51' is also disposed back to front relative to the locking plate 77 in the first embodiment. A connecting arm 111 connecting the right and left connecting pins 75 are mounted on the pins 75 so as to be swingable. The connecting arm 11 has a length that is set so that a distance between the connecting pins 75 is equal to a distance between the upper pivot pins 59 and 60 or the lower pivot pins 57 and 58. The upper support pillars 73 and the connecting arm 111 and the lower support pillars 74 and the connecting arm 111 constitute parallel link mechanisms respectively. The locking plates 77' and 78 have grooves (not shown) which limit ranges of swinging movement of the upper support pillars 73, respectively. The divided support pillars 51' and 52 are switched between the first position as shown in FIG. 16A and the second position as shown in FIG. 16B. The divided support pillars 51' and 52 vertically extend in parallel with each other when assuming the first position. Each of the pillars 51' and 52 is bent into a generally angled shape.

The connecting arm 111 may be eliminated, and a gear mechanism (not shown) may be provided instead of the sector gears 81 and 82. The gear mechanism rotates the lower support pillars 74 about the lower pivot pins 57 and 58 in one and the same direction of arrow D6 in FIG. 16B. The gear mechanism comprises a pair of gears which are disposed on the lower ends of the lower support pillars 74 and have the same pitch diameter, and an intermediate gear disposed between the gears. The paired gears are mesh-engaged with the intermediate gear so that the lower support pillars 74 are rotated by the same angle in the same direction. The divided support pillars 51' and 52 are switched between the first and second positions while remaining in parallel with each other.

According to the above-described thread guide mechanism 110, the divided support pillars 51' and 52 can easily be switched between the first and second positions. The thread guide member 50 can also be supported in the horizontal state. The thread guide member 50 is moved to the accommodation position relative to the support base 20 when the divided support pillars 51' and 52 assume the second position. Consequently, the thread guide mechanism 110 can easily be carried and accommodated without being bulky in the upward direction. Thus, the second embodiment can achieve the same effect as the first embodiment.

The spool holder may be applied to various types of sewing machine although the spool holder is applied to the multi-needle sewing machine M in the foregoing embodiments. Furthermore, the support base 20 and the divided spool brackets 22 and 23 constitute the spool bracket in the foregoing embodiments. However, the spool bracket may comprise a single spool base on which a plurality of thread spools are directly placed, instead. An entire shape of the spool bracket, an arrangement of thread spools may be changed suitably.

Each divided support pillar may only be switchable between the first and second positions. For example, the accommodation location of the thread guide member may be set to a location lower than the location shown in FIG. 15. The upper and lower support pillars may have different lengths.

The divided support pillar should not be limited to the two divided support pillars 51 and 52 in the foregoing embodiments. A single divided support pillar may be provided, instead. The swing locking unit 72 may be disposed on the lower end of the divided support pillar, a gear mechanism comprising the gears 81 and 82 or the like may be provided on the upper end of the divided support pillar. Although the swing locking unit 72 comprising the engagement screw 80, another locking mechanism may be provided, instead, and may comprise a leaf spring which locks the upper or lower support pillar. The number of needle bars may be larger or smaller than 10 and the number of thread guides may be set according to the number of needle bars.

The foregoing description and drawings are merely illustrative and are not to be construed in a limiting sense. Various changes and modifications will become apparent to those of ordinary skill in the art. All such changes and modifications are seen to fall within the scope as defined by the appended claims.

What is claimed is:

1. A spool holder comprising:

a spool base to which a plurality of thread spools are attachable; and a thread guide mechanism that guides a plurality of threads extending from the thread spools attached to the spool base, at a location higher than the thread spools, the thread guide mechanism including:

a thread guide member having a plurality of thread guide portions that are lined substantially horizontally and guide the threads extending from the thread spools, respectively;

a divided support pillar that is disposed so as to support the thread guide member on the spool base and including an upper support pillar having an upper end which is swingably mounted on the thread guide member and a lower support pillar having a lower end which is swingably mounted on the spool base;

a connecting part which connects the upper and lower support pillars so that the upper and lower support pillars are swingable; and a holding unit which holds the divided support pillar so that the divided support pillar is switchable between a first position where the upper and lower support pillars are substantially vertically lined so that the thread guide member is located at an upper position in use thereof and a second position where the upper and lower support pillars are bent at the connecting part so that the thread guide member is located at an accommodation position in non-use thereof.

2. The spool holder according to claim 1, wherein the upper and lower support pillars have respective lengths that are substantially equal to each other.

3. The spool holder according to claim 1, wherein:

the thread guide mechanism includes another divided support pillar further including another pair of upper and lower support pillars which are independent of the upper and lower support pillars respectively;

both divided support pillars are disposed symmetrically on the spool base; and a lengthwise middle of the thread guide member is supported by upper ends of the upper support pillars.

4. The spool holder according to claim 3, wherein:

both divided support pillars include gears provided on lower ends of the lower support pillars respectively;

the gears are mesh-engaged with each other so that the lower support pillars are swung about lower ends of the lower support pillars respectively, whereby both divided support pillars are switched between the first and second positions respectively.

5. The spool holder according to claim 1, wherein the holding unit includes an elastic member which is provided on the connecting part to elastically urge the upper and lower support pillars so that the upper and lower support pillars assume the first position and a swing locking unit which is provided on an upper end of the upper support pillar to lock the upper support pillar during swinging.

6. The spool holder according to claim 5, wherein the swing locking unit is constructed so as to lock the upper support pillar during swinging when the divided support pillar assumes the intermediate position between the first and second positions.

7. A sewing machine which includes a spool holder comprising:

a spool base to which a plurality of thread spools are attachable; and a thread guide mechanism that guides a plurality of threads extending from the thread spools attached to the spool base, at a location higher than the thread spools, the thread guide mechanism including:

a plurality of thread guide members having a plurality of thread guide portions that are lined substantially horizontally and guide the threads extending from the thread spools, respectively;

a divided support pillar that is disposed so as to support the thread guide member on the spool base and including an upper support pillar having an upper end, which is swingably mounted on the thread guide member and a lower support pillar having a lower end which is swingably mounted on the spool base;

a connecting part which connects the upper and lower support pillars so that the upper and lower support pillars are swingable; and a holding unit which holds the divided support pillar so that the divided support pillar is switchable between a first position where the upper and lower support pillars are substantially vertically lined so that the thread guide member is located at an upper position in use thereof and a second position where the upper and lower support pillars are bent at the connecting part so that the thread guide member is located at an accommodation position in non-use thereof.

8. The sewing machine according to claim 7, further comprising a detecting unit which detects the first or second position of the divided support pillar and an informing unit which informs of the first or second position of the divided support pillar detected by the detecting unit.

* * * * *